US011753966B1

(12) United States Patent
Bolgar

(10) Patent No.: US 11,753,966 B1
(45) Date of Patent: Sep. 12, 2023

(54) CASING ASSEMBLY FOR GAS TURBINE ENGINE

(71) Applicant: ROLLS-ROYCE plc, London (GB)

(72) Inventor: Crispin D. Bolgar, Nottingham (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 18/167,420

(22) Filed: Feb. 10, 2023

(30) Foreign Application Priority Data

Feb. 25, 2022 (GB) ..... 2202610

(51) Int. Cl.
*F01D 25/24* (2006.01)
*F01D 9/04* (2006.01)

(52) U.S. Cl.
CPC ..... *F01D 25/24* (2013.01); *F01D 9/04* (2013.01); *F01D 25/243* (2013.01); *F05D 2220/32* (2013.01); *F05D 2240/12* (2013.01); *F05D 2240/14* (2013.01)

(58) Field of Classification Search
CPC ..... F01D 9/04; F01D 25/24; F01D 25/243; F05D 2220/32; F05D 2240/11; F05D 2240/14
See application file for complete search history.

(56) References Cited

U.S. PATENT DOCUMENTS 5,357,744 A * 10/1994 Czachor ..... F16B 43/025 415/134
6,352,404 B1 3/2002 Czachor et al.
6,494,677 B1 12/2002 Grady
7,797,922 B2 * 9/2010 Eleftheriou ..... F01D 25/24 415/208.4
9,039,364 B2 * 5/2015 Alvanos ..... F01D 25/246 415/209.1
11,073,033 B2 * 7/2021 Hall ..... F01D 25/26
2004/0067131 A1 * 4/2004 Joslin ..... F01D 5/225 415/191
2009/0047126 A1 2/2009 Ress, Jr.
2013/0000324 A1 1/2013 Alvanos et al.

FOREIGN PATENT DOCUMENTS

GB 789733 A 1/1958
GB 960812 A 6/1964

OTHER PUBLICATIONS

Great Britain search report dated Jul. 20, 2022, issued in GB Patent Application No. 2202610.8.
European search report dated Jun. 30, 2023, issued in EP Patent Application No. 23153187.

* cited by examiner

*Primary Examiner* — Igor Kershteyn

(57) ABSTRACT

A casing assembly for a gas turbine engine includes a plurality of vane casing segments. Each vane casing segment includes an arcuate member and a pair of split-line flanges. Each split-line flange includes a first axial flange end and a second axial flange end. Each split-line flange is fixedly coupled to an adjacent split-line flange of an adjacent vane casing segment. Each vane casing segment includes at least one row of stator vanes welded to the arcuate member. Each split-line flange is at least partially and circumferentially inclined relative to a rotational axis of the gas turbine engine, such that the first axial flange end is circumferentially offset from the second axial-flange end. Further, each split-line flange includes an intersecting portion, such that at least the intersecting portion of each split-line flange is circumferentially inclined relative to the rotational axis.

20 Claims, 13 Drawing Sheets

CASING ASSEMBLY FOR GAS TURBINE ENGINE

CROSS-REFERENCE TO RELATED APPLICATIONS

This specification is based upon and claims the benefit of priority from United Kingdom patent application number GB 2202610.8 filed on Feb. 25, 2022, the entire contents of which is incorporated herein by reference.

BACKGROUND

Technical Field

The present disclosure generally relates to gas turbine engines, more particularly, to a casing assembly for a turbine or a compressor of a gas turbine engine.

Description of the Related Art

A gas turbine engine generally includes a turbine and a compressor. Each of the turbine and the compressor includes a casing, and a stator and a rotor disposed within the casing. The stator may include a number of vanes that are coupled to the casing. Further, in some examples, the casing may be split axially into two halves along a horizontal plane. The two halves may be bolted together via mating flanges. Conventionally, the vanes may be connected to the casing using mechanical fasteners, such as, bolts. Such mechanical fasteners may increase a number of parts associated with the gas turbine engine, a cost associated with manufacturing of the gas turbine engine, and an overall weight of the gas turbine engine. Further, conventional vane and casing assemblies may not have a robust design. Moreover, it may be challenging to assemble the vane and casing assembly around the rotor, which may increase a time and cost associated with an assembling of the gas turbine engine.

The casing may include one or more shrouds that may be connected with the vanes of the stator. Such shrouds may include a number of shroud segments. Conventionally, adjacent shroud segments may be connected to each other by various joining techniques, such as, welding or using mechanical fasteners. However, such joining techniques may require multiple machining and/or fabrication operations which may add to a manufacturing cost and may also introduce a risk of damage to other surrounding components, for example, if the mechanical fasteners get loose and escape into a main gas flow path. Further, usage of mechanical fasteners to join adjacent shroud segments may increase the weight and cost associated with the gas turbine engine.

SUMMARY

In a first aspect, there is provided a casing assembly for a gas turbine engine having a rotational axis. The casing assembly includes a plurality of vane casing segments circumferentially arranged about the rotational axis and disposed adjacent to each other. Each vane casing segment includes an arcuate member extending circumferentially about the rotational axis. The arcuate member includes a first axial end portion and a second axial end portion axially spaced apart from the first axial end portion relative to the rotational axis. The arcuate member further includes a pair of circumferential ends circumferentially spaced apart from each other relative to the rotational axis and extending between the first axial end portion and the second axial end portion. The arcuate member further includes at least one row of casing apertures circumferentially spaced apart from each other relative to the rotational axis. Each vane casing segment further includes a pair of split-line flanges circumferentially spaced apart from each other relative to the rotational axis. Each split-line flange from the pair of split-line flanges is integral with and radially extends from the arcuate member relative to the rotational axis. Each split-line flange is disposed at a corresponding circumferential end from the pair of circumferential ends of the arcuate member and extends from the first axial end portion of the arcuate member to the second axial end portion of the arcuate member. Each split-line flange includes a first axial flange end disposed adjacent to the first axial end portion, a second axial flange end disposed adjacent to the second axial end portion, and a mating surface extending between the first axial flange end and the second axial flange end. Each split-line flange is fixedly coupled to an adjacent split-line flange from the pair of split-line flanges of an adjacent vane casing segment from the plurality of vane casing segments. Each vane casing segment further includes at least one row of stator vanes circumferentially spaced apart from each other relative to the rotational axis and fixedly coupled to the arcuate member. Each stator vane of the at least one row of stator vanes includes an aerofoil extending at least radially relative to the rotational axis from a radially inner end to a radially outer end, and an outer platform disposed at the radially outer end of the aerofoil. The outer platform is at least partially received within a corresponding casing aperture of the at least one row of casing apertures of the arcuate member and welded to the arcuate member. The at least one row of stator vanes is circumferentially disposed between the pair of split-line flanges. The at least one row of stator vanes includes a pair of end stator vanes disposed at corresponding opposite row ends, such that each end stator vane from the pair of end stator vanes is disposed adjacent to a corresponding split-line flange from the pair of split-line flanges. Each split-line flange is at least partially and circumferentially inclined relative to the rotational axis, such that the first axial flange end is circumferentially offset from the second axial flange end. Further, each split-line flange includes an intersecting portion disposed adjacent to the at least one row of stator vanes. At least the intersecting portion of each split-line flange is circumferentially inclined relative to the rotational axis, such that the outer platform of each end stator vane is at least circumferentially spaced apart from the corresponding split-line flange by a minimum circumferential clearance.

The casing assembly of the present disclosure may be robust in design. The casing assembly may also be convenient to assemble around a rotor associated with a turbine or a compressor of the gas turbine engine, without compromising with a design of the rotor. Further, as the stator vanes are coupled to the arcuate member by welding, the casing assembly may have a lower weight as the casing assembly may not require mechanical fasteners, such as bolts, for coupling of the stator vanes with the arcuate member. Furthermore, the casing assembly may be cost efficient due to usage of lower volume of materials for manufacturing of the casing assembly. Moreover, the minimum circumferential clearance between the end stator vane and the split-line flange may eliminate an interference between the end stator vane and the corresponding split-line flange. The minimum circumferential clearance may further provide sufficient access for welding of the outer platform of the end stator vane with the arcuate member without any interference with the split-line flange.

In some embodiments, the casing assembly further includes at least one vane plate unit at least partially and circumferentially disposed between at least one split-line flange from the pair of split-line flanges of at least one vane casing segment from the plurality of vane casing segments and the adjacent split-line flange of the adjacent vane casing segment. The vane plate described herein may be used when a clearance between the end stator vanes of adjacent vane casing segments is such that it may be challenging to accommodate the split-line flanges therebetween.

The vane plate unit includes a vane plate including a first mating surface at least partially engaging with the mating surface of the at least one split-line flange of the at least one vane casing segment and an opposing second mating surface at least partially engaging with the mating surface of the adjacent split-line flange of the adjacent vane casing segment. The vane plate is fixedly coupled to each of the at least one split-line flange and the adjacent split-line flange, such that the at least one split-line flange is fixedly coupled to the adjacent split-line flange via the vane plate. The vane plate is at least partially and circumferentially inclined relative to the rotational axis. The vane plate further includes at least one plate stator vane fixedly coupled to and extending at least radially from the vane plate. The at least one plate stator vane is circumferentially disposed between the proximal end stator vane of the at least one vane casing segment and the proximal end stator vane of the adjacent vane casing segment, such that the at least one row of stator vanes of the at least one vane casing segment, the at least one plate stator vane of the vane plate unit, and the at least one row of stator vanes of the adjacent vane casing segment together at least partially form a single circumferential row of stator vanes. The vane plate may be disposed such that a desired clearance may be maintained between the plate stator vane and the end stator vane of each of the adjacent vane casing segments.

In some embodiments, the vane plate has an angular extent about the rotational axis. The arcuate member of each vane casing segment has an angular extent about the rotational axis. The angular extent of each vane casing segment is greater than the angular extent of the vane plate by at least a factor of 20. The angular extent of the vane plate may be governed by a desired clearance between the end stator vanes of adjacent vane casing segments.

In some embodiments, the vane plate further includes an intersecting portion axially intersecting the single circumferential row of stator vanes. At least the intersecting portion of the vane plate, at least the intersecting portion of the at least one split-line flange of the at least one vane casing segment, and at least the intersecting portion of the adjacent split-line flange of the adjacent vane casing segment are circumferentially inclined relative to the rotational axis by a same circumferential angle. The circumferentially inclined intersecting portion of the vane plate may ensure that the plate stator vane is equidistantly disposed between each of the adjacent vane casing segments.

In some embodiments, the vane plate further includes at least one plate aperture. The at least one plate stator vane includes an aerofoil extending at least radially relative to the rotational axis from a radially inner end to a radially outer end, and an outer platform disposed at the radially outer end of the aerofoil. The outer platform is at least partially received within the at least one plate aperture of the vane plate. The outer platform of the at least one plate stator vane defines a chordal axis extending between opposing axial ends of the outer platform. The chordal axis is circumferentially inclined relative to the rotational axis by the same circumferential angle. Further, the plate stator vane may either be integrally formed with the vane plate or the plate stator vane may be coupled to the vane plate by welding, thereby eliminating usage of additional components, such as, mechanical fasteners. Thus, additional weight and cost associated with such additional components may be eliminated.

In some embodiments, the plurality of vane casing segments includes at least three vane casing segments, such that the angular extent of the arcuate member of each of the at least three vane casing segments is less than 180 degrees about the rotational axis. The at least one vane plate unit includes at least three vane plate units, such that each of the at least three vane plate units is at least partially and circumferentially disposed between corresponding adjacent vane casing segments of the at least three vane casing segments. The three vane casing segments may allow easy assembly of the casing assembly around the rotor.

In some embodiments, the mating surface of at least one split-line flange from the pair of split-line flanges of at least one vane casing segment from the plurality of vane casing segments at least partially engages with the mating surface of the adjacent split-line flange of the adjacent vane casing segment, such that the at least one row of stator vanes of the at least one vane casing segment at least partially forms a single circumferential row of stator vanes, and wherein at least one split-line flange of the at least one vane casing segment is directly and fixedly coupled to the adjacent split-line flange of the adjacent vane casing segment.

In some embodiments, the arcuate member of the at least one vane casing segment has an angular extent of at most 180 degrees about the rotational axis. The arcuate member may allow easy assembly of the casing assembly around the rotor.

In some embodiments, the minimum circumferential clearance is from about 5 cm to about 10 cm. Such a range of the minimum circumferential clearance may eliminate any interference between the end stator vane and the corresponding split-line flange.

In some embodiments, at least the intersecting portion of at least one split-line flange of each vane casing segment is circumferentially inclined relative to the rotational axis by a circumferential angle. The outer platform of the end stator vane disposed adjacent to the at least one split-line flange defines a chordal axis extending between opposing axial ends of the outer platform. The chordal axis is circumferentially inclined relative to the rotational axis by the circumferential angle of the at least one split-line flange. The circumferentially inclined intersecting portion of the at least one split-line flange may ensure that the end stator vane of the vane casing segment is disposed at the minimum circumferential clearance from the at least one split-line flange. Further, the circumferentially inclined intersecting portion of the at least one split-line flange may ensure that the end stator vane does not interfere with the at least one split-line flange.

In some embodiments, the circumferential angle is from about 2 degrees to about 45 degrees. Such a range of the circumferential angle may eliminate any interference between the end stator vane and the at least one split-line flange.

In some embodiments, the at least one row of stator vanes further includes a plurality of rows of stator vanes axially spaced apart from each other relative to the rotational axis and fixedly coupled to the arcuate member. The at least one row of casing apertures further includes a plurality of rows of casing apertures corresponding to the plurality of rows of stator vanes. Each split-line flange further includes a plurality of intersecting portions disposed adjacent to a corresponding row of stator vanes from the plurality of rows of stator vanes. Further, at least one intersecting portion from the plurality of intersecting portions is circumferentially inclined relative to the rotational axis. The at least one circumferentially inclined intersecting portion may ensure that the end stator vane of the vane casing segment does not interfere with the corresponding split-line flange.

In some embodiments, each intersecting portion from the plurality of intersecting portions is circumferentially inclined relative to the rotational axis by a corresponding circumferential angle.

In some embodiments, the corresponding circumferential angles of at least two intersection portions from the plurality of intersection portions are different from each other. The different values of the circumferential angles may be based on different designs of the at least two rows of stator vanes corresponding to the at least two intersection portions.

In some embodiments, at least one of the plurality of intersecting portions extends parallel to the rotational axis. In such a case, a circumferential inclination of the at least one of the plurality of intersecting portions may not be required due to a design of the corresponding row of stator vanes.

In some embodiments, the casing assembly further includes a shroud radially spaced apart from the plurality of vane casing segments relative to the rotational axis. The shroud includes a plurality of shroud segments circumferentially arranged about the rotational axis and disposed adjacent to each other. Each shroud segment includes at least one row of shroud apertures circumferentially spaced apart from each other relative to the rotational axis. The radially inner end of the aerofoil of each stator vane of the at least one row of stator vanes is at least partially received within a corresponding shroud aperture of the at least one row of shroud apertures of a corresponding shroud segment from the plurality of shroud segments. Each stator vane may be therefore radially supported between the corresponding vane casing segment and shroud segments.

In some embodiments, each shroud segment and an adjacent shroud segment together form an interlocking arrangement that connects each shroud segment to the adjacent shroud segment. Such an interlocking arrangement may eliminate any axial movement of the shroud segments relative to the rotational axis. Further, the interlocking arrangement does not include any additional components, such as, mechanical fasteners, thereby eliminating a cost and weight associated with such additional components. The interlocking arrangement may provide improved vibration damping, seal clearance, and minimize leakage without incurring additional cost associated with fabricating and machining mating features.

In some embodiments, the interlocking arrangement includes at least one of a Z-shaped arrangement, a V-shaped arrangement with axial end portions, a V-shaped arrangement, and a zigzag arrangement. Such interlocking arrangements may eliminate any axial movement of the shroud segments relative to the rotational axis.

In some embodiments, the casing assembly further includes a potting material disposed in each shroud aperture of the at least one row of shroud apertures, such that the potting material surrounds the radially inner end of the aerofoil received within the corresponding shroud aperture and fixedly couples the radially inner end to the corresponding shroud segment. The potting material may provide retention and damping of the radially inner end of the aerofoil. Further, the potting material may also provide a rubbing surface for seal fins.

In a second aspect, there is provided a turbine for a gas turbine engine. The turbine includes the casing assembly of the first aspect.

In a third aspect, there is provided a compressor for a gas turbine engine. The compressor includes the casing assembly of the first aspect.

In a fourth aspect, there is provided a gas turbine engine including the casing assembly of the first aspect.

As noted elsewhere herein, the present disclosure may relate to gas turbine engines. Such gas turbine engines may comprise an engine core comprising a turbine, a combustor, a compressor, and a core shaft connecting the turbine to the compressor. Such gas turbine engines may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example, via a spur shaft and/or gear. The core shaft may rigidly connect the turbine and the compressor, such that the turbine and the compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example, one, two, or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, the second compressor, and the second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example, the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and the second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and the second turbine as described above) may comprise any number of stages, for example, multiple stages. Each stage may comprise a row of rotor blades and a row of stator vanes. The row of rotor blades and the row of stator vanes may be axially offset from each other.

A fan blade and/or aerofoil portion of a fan blade described and/or claimed herein may be manufactured from any suitable material or combination of materials. For example, at least a part of the fan blade and/or aerofoil may be manufactured at least in part from a composite, for example, a metal matrix composite and/or an organic matrix composite, such as carbon fibre. By way of further example, at least a part of the fan blade and/or aerofoil may be manufactured at least in part from a metal, such as, a titanium-based metal or an aluminium based material (such as an aluminium-lithium alloy) or a steel-based material. The fan blade may comprise at least two regions manufactured using different materials. For example, the fan blade may have a protective leading edge, which may be manufactured using a material that is better able to resist impact (for example from birds, ice, or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example, in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades maybe formed integrally with a central portion. Such an arrangement may be referred to as a bladed disc or a bladed ring. Any suitable method may be used to manufacture such a bladed disc or bladed ring. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example, 14, 16, 18, 20, 22, 24, or 26 fan blades.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
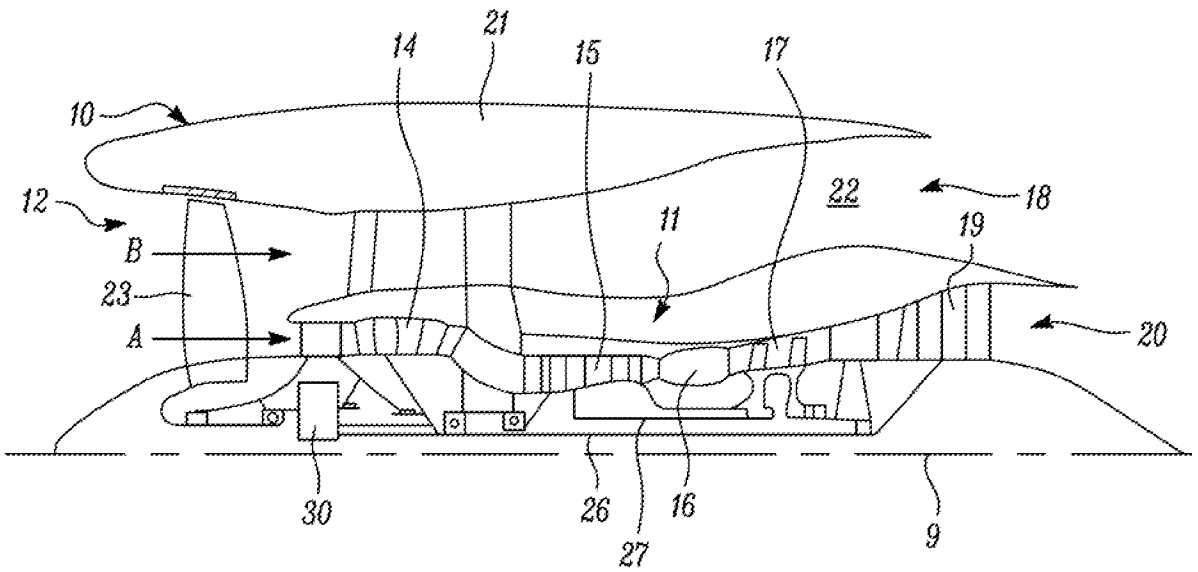
FIG. 1 is a sectional side view of a gas turbine engine.

FIG. 1 illustrates a gas turbine engine 10 having a rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high pressure compressor 15, a combustion equipment 16, a high pressure turbine 17, a low pressure turbine 19, and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
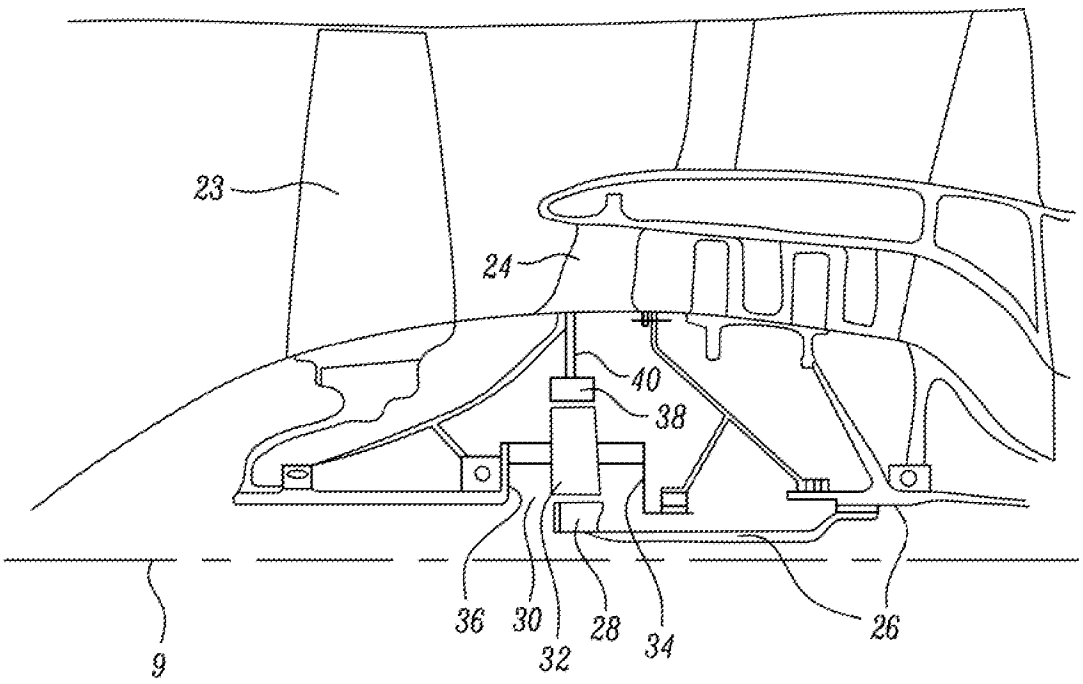
FIG. 2 is a close-up sectional side view of an upstream portion of the gas turbine engine of FIG. 1.

An exemplary arrangement for a geared fan gas turbine engine 10 is shown in FIG. 2. The low pressure turbine 19 (see FIG. 1) drives the shaft 26, which is coupled to a sun wheel, or sun gear 28 of the epicyclic gearbox 30. Radially outwardly of the sun gear 28 and intermeshing therewith is a plurality of planet gears 32 that are coupled together by a planet carrier 34. The planet carrier 34 constrains the planet gears 32 to process around the sun gear 28 in synchronicity whilst enabling each planet gear 32 to rotate about its own axis. The planet carrier 34 is coupled via linkages 36 to the fan 23 in order to drive its rotation about the rotational axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e., not including the fan 23) respectively and/or the turbine and compressor stages that are connected together by the shaft 26 with the lowest rotational speed in the engine 10 (i.e., not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
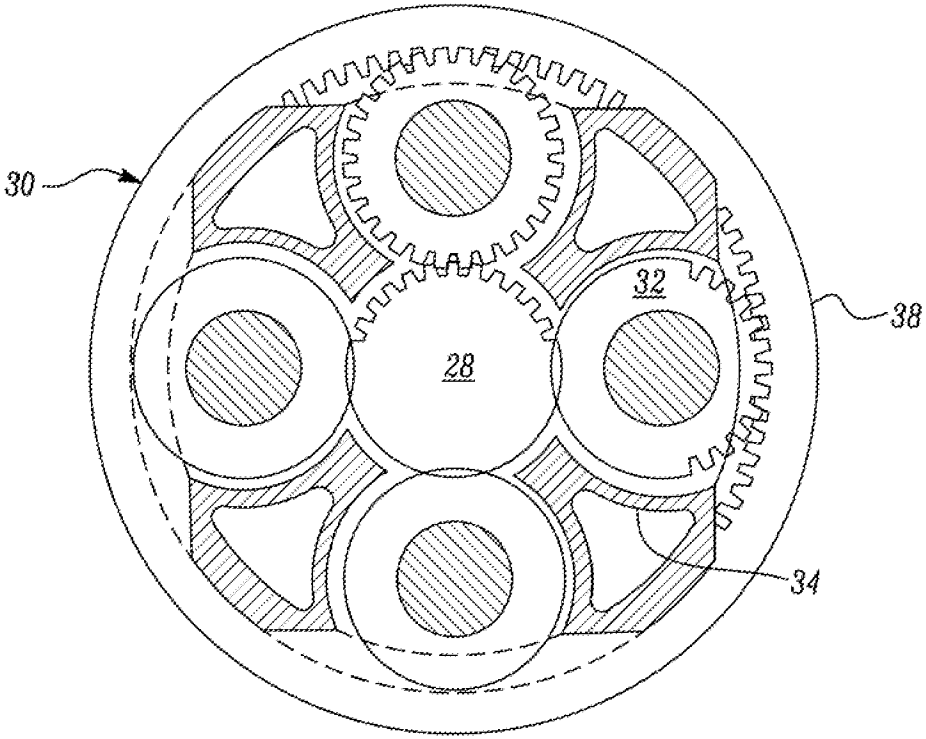
FIG. 3 is a partially cut-away view of a gearbox of the gas turbine engine of FIG. 1.

The epicyclic gearbox 30 is shown by way of example in greater detail in FIG. 3. Each of the sun gear 28, the planet gears 32, and the ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement, the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as, the linkages 36, 40 in the FIG. 2 example) between the gearbox 30 and other parts of the engine 10 (such as the input shaft 26, the output shaft, and the fixed structure 24) may have any desired degree of stiffness or flexibility. By way of further example, any suitable arrangement of the bearings between rotating and stationary parts of the engine 10 (for example, between the input and output shafts from the gearbox and the fixed structures, such as, the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example, star or planetary), support structures, input and output shaft arrangements, and bearing locations.

Optionally, the gearbox may drive additional and/or alternative components (e.g., the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine 10 shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as, an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial, and circumferential directions are mutually perpendicular.

In addition, the present invention is equally applicable to aero gas turbine engines, marine gas turbine engines, and land-based gas turbine engines.

Figure 4:
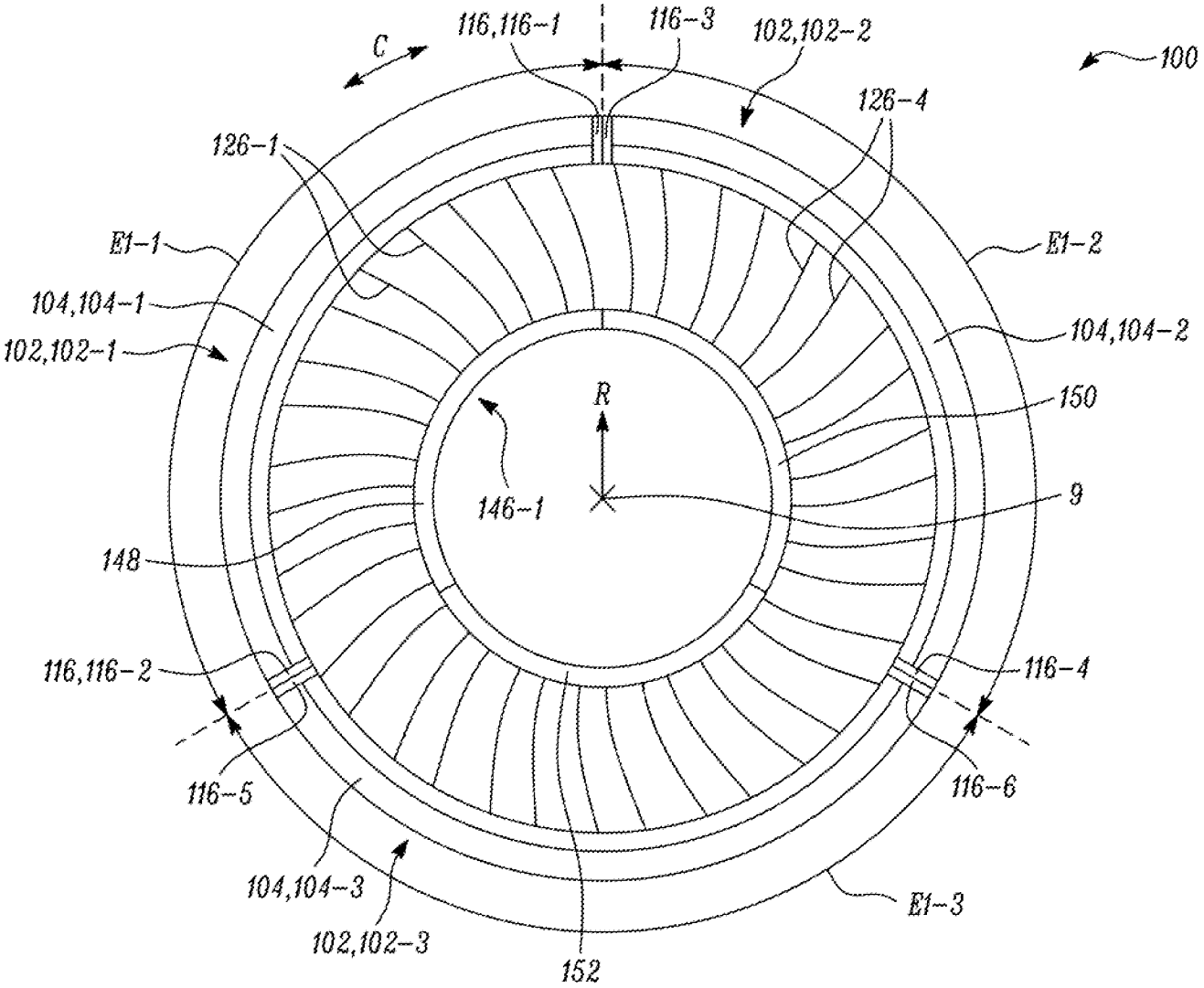
FIG. 4 is a schematic front view of a casing assembly associated with the gas turbine engine of FIG. 1.

FIG. 4 shows a schematic perspective view of a casing assembly 100 for the gas turbine engine 10 (see FIG. 1) having the rotational axis 9. In an embodiment, the turbine 17, 19 (see FIG. 1) for the gas turbine engine 10 includes the casing assembly 100. In another embodiment, the compressor 14, 15 (see FIG. 1) for the gas turbine engine 10 includes the casing assembly 100. A radial direction R is defined with respect to the rotational axis 9 of the gas turbine engine 10. As used herein, terms that refer to a radial direction, such as "radially outer", "radially inner", "radially extending", "radially inwards", "radially outwards", and "radially proximal", are with respect to the radial direction R. A circumferential direction C is defined with respect to the rotational axis 9. As used herein, terms that refer to a circumferential direction, such as "circumferential extends", "circumferentially extending", "circumferentially inclined", and "circumferentially disposed between", are with respect to the circumferential direction C.

The casing assembly 100 includes a plurality of vane casing segments 102-1, 102-2, 102-3 circumferentially arranged about the rotational axis 9 and disposed adjacent to each other. In the illustrated embodiment of FIG. 4, the plurality of vane casing segments 102-1, 102-2, 102-3 includes at least three vane casing segments 102-1, 102-2, 102-3. The three vane casing segments 102-1, 102-2, 102-3 may allow easy assembly of the casing assembly 100 around a rotor (not shown) of the turbine 17, 19 or the compressor 14, 15.

Each vane casing segment 102-1, 102-2, 102-3 extends about the rotational axis 9. Each vane casing segment 102-1, 102-2, 102-3 includes an arcuate member 104-1, 104-2, 104-3 extending circumferentially about the rotational axis 9. In some embodiments, the arcuate member 104-1, 104-2, 104-3 of the at least one vane casing segment 102-1, 102-2, 102-3 has an angular extent E1-1, E1-2, E1-3 of at most 180 degrees about the rotational axis 9. The vane casing segment 102-1 includes a pair of split-line flanges 116-1, 116-2 circumferentially spaced apart from each other relative to the rotational axis 9. The vane casing segment 102-2 includes a pair of split-line flanges 116-3, 116-4 circumferentially spaced apart from each other relative to the rotational axis 9. The vane casing segment 102-3 includes a pair of split-line flanges 116-5, 116-6 circumferentially spaced apart from each other relative to the rotational axis 9. The designs of the split-line flanges 116-1, 116-2, 116-3, 116-4, 116-5, 116-6 may be similar to each other.

The vane casing segments 102-1, 102-2, 102-3 may be similar to each other in design and dimensions. The vane casing segments 102-1, 102-2, 102-3 may be hereinafter collectively referred to as the vane casing segment 102. Moreover, the term "vane casing segment 102" may be interchangeably used herein for each vane casing segment 102-1, 102-2, 102-3, without any limitations. Additionally, the term "plurality of vane casing segments 102" may be interchangeably used herein for the plurality of vane casing segments 102-1, 102-2, 102-3, without any limitations. Further, the arcuate member 104-1, 104-2, 104-3 may be hereinafter collectively referred to as the arcuate member 104. Moreover, the term "arcuate member 104" may be interchangeably used herein for each arcuate member 104-1, 104-2, 104-3, without any limitations.

Figure 5:
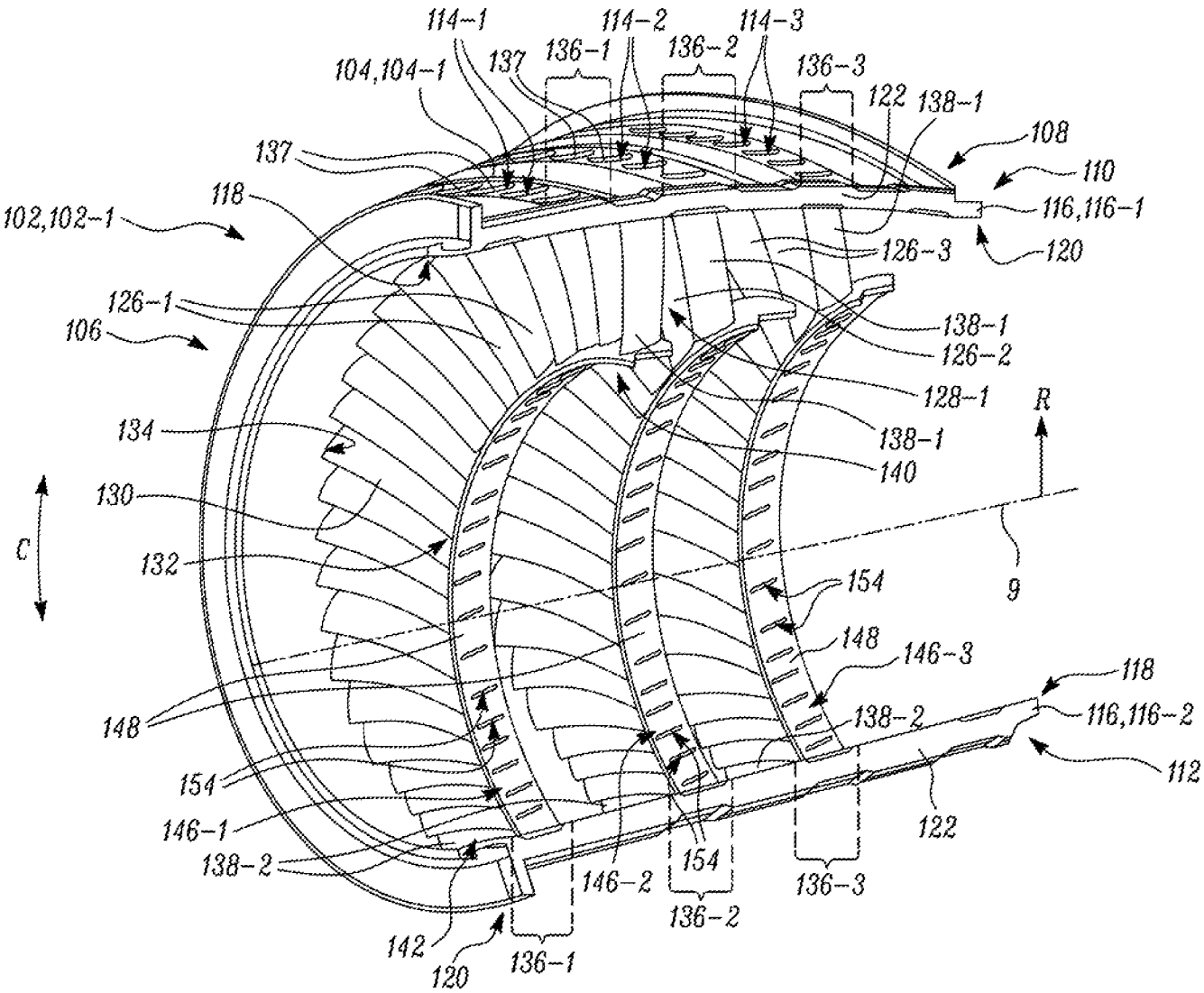
FIG. 5 is a schematic perspective view of a vane casing segment associated with the casing assembly of FIG. 4.

FIG. 5 illustrates the single vane casing segment 102 of the casing assembly 100. As illustrated in FIG. 5, each vane casing segment 102 includes the pair of split-line flanges 116-1, 116-2 circumferentially spaced apart from each other relative to the rotational axis 9. The split-line flange 116-1, 116-2 may be hereinafter collectively referred to as the split-line flange 116. Moreover, the term "split-line flange 116" may be interchangeably used herein for each split-line flange 116-1, 116-2, without any limitations. Additionally, the term "pair of split-line flanges 116" may be interchangeably used herein for the pair of split-line flange 116-1, 116-2, without any limitations.

The arcuate member 104 includes a first axial end portion 106. The arcuate member 104 also includes a second axial end portion 108 axially spaced apart from the first axial end portion 106 relative to the rotational axis 9. The arcuate member 104 further includes a pair of circumferential ends 110, 112 circumferentially spaced apart from each other relative to the rotational axis 9 and extending between the first axial end portion 106 and the second axial end portion 108. Further, the arcuate member 104 includes at least one row of casing apertures 114-1, 114-2, 114-3 circumferentially spaced apart from each other relative to the rotational axis 9. In some embodiments, the at least one row of casing apertures 114-1, 114-2, 114-3 includes a plurality of rows of casing apertures 114-1, 114-2, 114-3. In the illustrated embodiment of FIG. 5, the at least one row of casing apertures 114-1, 114-2, 114-3 includes three rows of casing apertures 114-1, 114-2, 114-3.

Further, each split-line flange 116 from the pair of split-line flanges 116 may be integral with and radially extends from the arcuate member 104 relative to the rotational axis 9. Each split-line flange 116 may be disposed at a corresponding circumferential end 110, 112 from the pair of circumferential ends 110, 112 of the arcuate member 104 and may extend from the first axial end portion 106 of the arcuate member 104 to the second axial end portion 108 of the arcuate member 104. Specifically, the split-line flange 116-1 is disposed at the circumferential end 110 and the split-line flange 116-2 is disposed at the circumferential end 112.

Each split-line flange 116 includes a first axial flange end 118 disposed adjacent to the first axial end portion 106. Each split-line flange 116 also includes a second axial flange end 120 disposed adjacent to the second axial end portion 108. Each split-line flange 116 further includes a mating surface 122 extending between the first axial flange end 118 and the second axial flange end 120. The mating surface 122 includes a planar shape herein. Alternatively, the mating surface 122 may include any other shape, such as, a curved or helical shape, without any limitations. Further, each split-line flange 116 includes an intersecting portion 136-1, 136-2, 136-3 disposed adjacent to at least one row of stator vanes 126-1, 126-2, 126-3. Specifically, the split-line flange 116 includes three intersecting portions 136-1, 136-2, 136-3 disposed adjacent to the rows of stator vanes 126-1, 126-2, 126-3, respectively.

Figure 6:
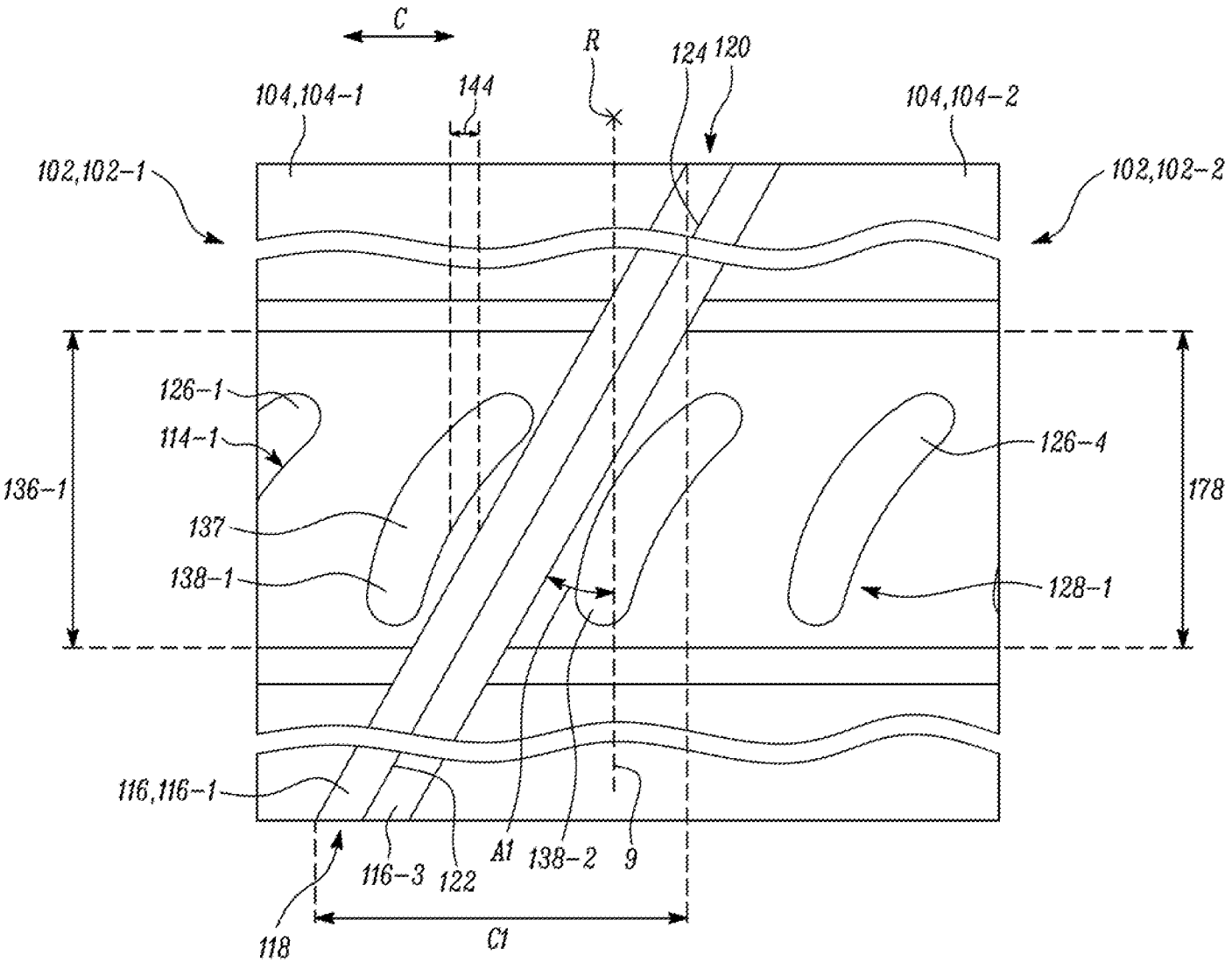
FIG. 6 is a schematic partial plan view illustrating the vane casing segment of FIG. 5 coupled with an adjacent vane casing segment.

Referring now to FIG. 6, the single split-line flange 116 is illustrated. As illustrated in FIG. 6, each split-line flange 116 is fixedly coupled to an adjacent split line-flange 116-3 from the pair of split-line flanges 116-3, 116-4 (see FIG. 4) of the adjacent vane casing segment 102 from the plurality of vane casing segments 102. Specifically, the split-line flange 116-1 of the vane casing segment 102-1 is fixedly coupled to the adjacent split line-flange 116-3 of the vane casing segment 102-2. In the illustrated embodiment of FIG. 6, the at least one split-line flange 116 of the at least one vane casing segment 102 is directly and fixedly coupled to an adjacent split-line flange 116-3 of the adjacent vane casing segment 102. Further, the split-line flange 116 may be fixedly connected to the split-line flange 116-3 via mechanical fasteners (not shown), such as, bolts, screws, pins, and the like. It should be noted that the present disclosure is not limited by a technique of coupling the split-line flange 116 with the split-line flange 116-3. Further, the split-line flanges 116, 116-3 may include features, such as, apertures (not shown), to receive the mechanical fasteners.

In some embodiments, the mating surface 122 of the at least one split-line flange 116 from the pair of split-line flanges 116 of the at least one vane casing segment 102 from the plurality of vane casing segments 102 at least partially engages with a mating surface 124 of the adjacent split-line flange 116-3 of the adjacent vane casing segment 102, such that the at least one row of stator vanes 126-1 of the at least one vane casing segment 102 at least partially forms a single circumferential row of stator vanes 128-1. The mating surface 124 includes a planar shape herein. Alternatively, the mating surface 124 may include any other shape, such as, a curved or helix shape, without any limitations.

Further, each split-line flange 116 is at least partially and circumferentially inclined to the rotational axis 9, such that the first axial flange end 118 is circumferentially offset from the second axial flange end 120. Specifically, a circumferential offset Cl may be present between the first and second axial flange ends 118, 120.

As shown in FIG. 5, each vane casing segment 102 further includes the at least one row of stator vanes 126-1, 126-2, 126-3 circumferentially spaced apart from each other relative to the rotational axis 9 and fixedly coupled to the arcuate member 104. Details of the stator vane 126-1 will now be explained in reference to FIG. 5. However, the details provided below are equally applicable to the stator vanes 126-2, 126-3. Each stator vane 126-1 of the at least one row of stator vanes 126-1 includes an aerofoil 130 extending at least radially relative to the rotational axis 9 from a radially inner end 132 to a radially outer end 134. Further, each stator vane 126-1 of the at least one row of stator vanes 126-1 includes an outer platform 137 disposed at the radially outer end 134 of the aerofoil 130. The outer platform 137 is at least partially received within a corresponding casing aperture 114-1 of the at least one row of casing apertures 114-1, 114-2, 114-3 of the arcuate member 104 and welded to the arcuate member 104.

The at least one row of stator vanes 126-1 is circumferentially disposed between the pair of split-line flanges 116. The at least one row of stator vanes 126-1 includes a pair of end stator vanes 138-1, 138-2 disposed at corresponding opposite row ends 140, 142, such that each end stator vane 138-1 from the pair of end stator vanes 138-1, 138-2 is disposed adjacent to a corresponding split-line flange 116 from the pair of split-line flanges 116. The inclined split-flange 116 may eliminate a possibility of interference between the end stator vane 138-1 and the corresponding split-line flange 116.

As shown in FIG. 6, the intersecting portion 136-1 may mate with an intersecting portion 178 of the adjacent split-line flange 116-3. In some embodiments, at least the intersecting portion 136-1 of each split-line flange 116 is circumferentially inclined relative to the rotational axis 9, such that the outer platform 137 of each end stator vane 138-1 is at least circumferentially spaced apart from the corresponding split-line flange 116 by a minimum circumferential clearance 144. Further, the circumferentially inclined intersecting portion 136-1 of the at least one split-line flange 116 may ensure that the end stator vane 138-1 does not interfere with the corresponding split-line flange 116. The minimum circumferential clearance 144 may further provide sufficient access for welding of the outer platform 137 of the end stator vane 138-1 with the arcuate member 104 without any interference with the split-line flange 116. In the illustrated embodiment of FIG. 6, the entire split-line flange 116 is circumferentially inclined relative to the rotational axis 9, such that the outer platform 137 of each end stator vane 138-1 is at least circumferentially spaced apart from the corresponding split-line flange 116 by the minimum circumferential clearance 144. In some embodiments, the minimum circumferential clearance 144 is from about 5 cm to about 10 cm. Such a range of the minimum circumferential clearance 144 may eliminate any interference between the end stator vane 138-1 and the corresponding split-line flange 116.

In an embodiment, the mating surface 122 of the split-line flange 116 may be circumferentially inclined relative to the rotational axis 9 by a circumferential angle A1. In some embodiments, the circumferential angle A1 is from about 2 degrees to about 45 degrees. Further, the circumferential angle A1 may be from about 2 degrees to about 10 degrees, without any limitations. Such a range of the circumferential angle A1 may eliminate any interference between the end stator vane 138-1 and the at least one split-line flange 116. In some examples, the circumferential angle A1 may be obtained based on the minimum circumferential clearance 144 to be maintained between the end stator vane 138-1 and the split-line flange 116, without any limitations.

Figure 7B:
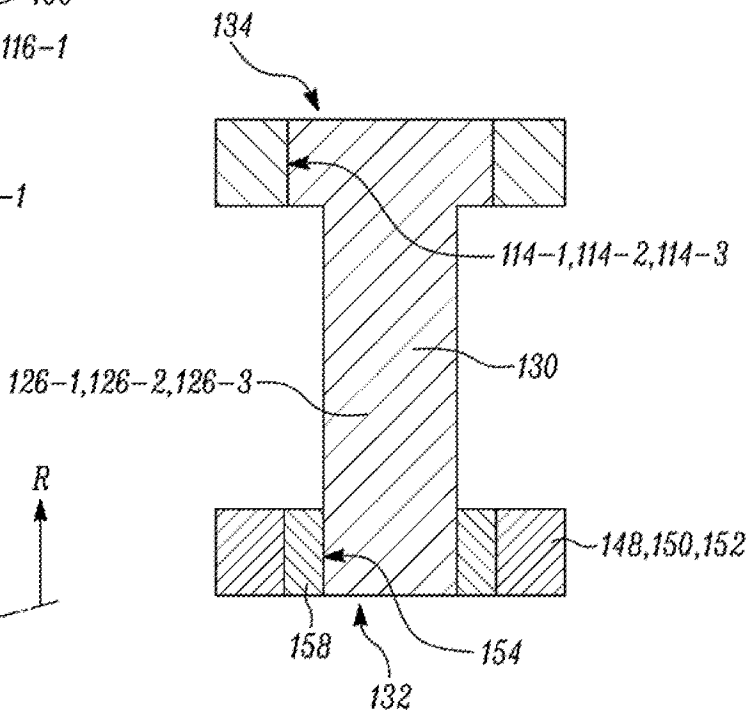
FIG. 7B is a schematic sectional view illustrating a shroud segment and a stator vane at least partially received within the shroud segment.
Figure 7A:
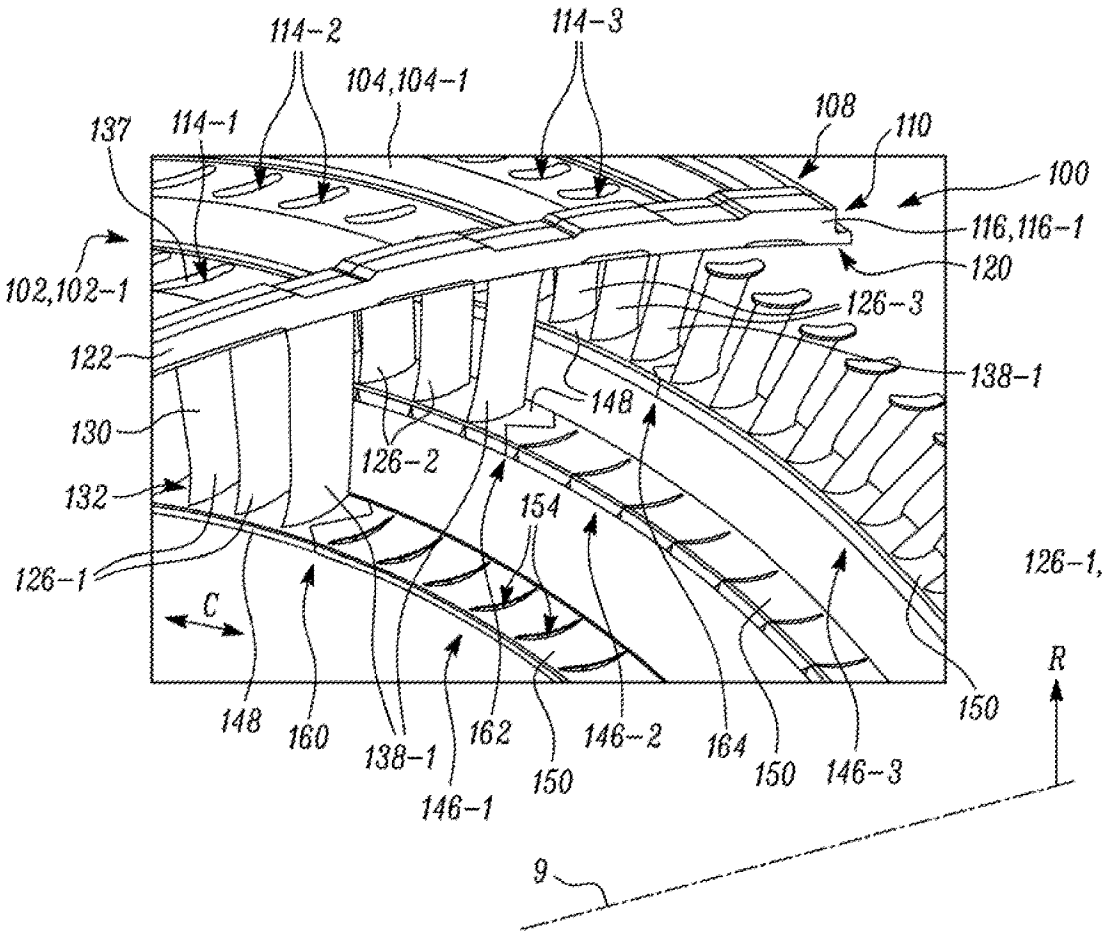
FIG. 7A is a schematic partial perspective view depicting a number of shrouds associated with the casing assembly of FIG. 4.

As shown in FIG. 7A, in some embodiments, the casing assembly 100 further includes a shroud 146-1, 146-2, 146-3 radially spaced apart from the plurality of vane casing segments 102 relative to the rotational axis 9. The shroud 146-1, 146-2, 146-3 may include a plurality of shroud segments 148, 150, 152 (see FIG. 4) circumferentially arranged about the rotational axis 9 and disposed adjacent to each other. As shown in FIG. 8, each shroud segment 148, 150, 152 may include at least one row of shroud apertures 154 circumferentially spaced apart from each other relative to the rotational axis 9. Further, the radially inner end 132 of the aerofoil 130 of each stator vane 126-1, 126-2, 126-3 of the at least one row of stator vanes 126-1 may be at least partially received within a corresponding shroud aperture 154 of the at least one row of shroud apertures 154 of a corresponding shroud segment 148, 150, 152 from the plurality of shroud segments 148, 150, 152. Each stator vane 126-1, 126-2, 126-3 may be therefore radially supported between the corresponding vane casing segment 102 and shroud segments 148, 150, 152.

As shown in FIG. 7B, in some embodiments, the casing assembly 100 further includes a potting material 158 disposed in each shroud aperture 154 of the at least one row of shroud apertures 154, such that the potting material 158 surrounds the radially inner end 132 of the aerofoil 130 received within the corresponding shroud aperture 154 and fixedly couples the radially inner end 132 to the corresponding shroud segment 148, 150, 152 (see FIG. 4). The potting material 158 may provide retention and damping of the radially inner end 132 of the aerofoil 130. Further, the potting material may also provide a rubbing surface for seal fins. The potting material 158 may include silicone or sprayed ceramic material, without any limitations. The potting material 158 may be selected such that it exhibits adequate damping and may be able to withstand high temperatures.

Referring again to FIG. 7A, in some embodiments, each shroud segment 148 and the adjacent shroud segment 150 together form an interlocking arrangement 160, 162, 164 that connects each shroud segment 148 to the adjacent shroud segment 150. For example, the interlocking arrangement 160 may connect the shroud segment 148 of the shroud 146-1 with the shroud segment 150 of the shroud 146-1. Further, the interlocking arrangement 162 may connect the shroud segment 148 of the shroud 146-2 with the shroud segment 150 of the shroud 146-2. Furthermore, the interlocking arrangement 164 may connect the shroud segment 148 of the shroud 146-3 with the shroud segment 150 of the shroud 146-3. The interlocking arrangement 160, 162, 164 may eliminate any axial movement of the shroud segments 148, 150, 152 relative to the rotational axis 9. Further, the interlocking arrangement 160, 162, 164 does not include any additional components, such as, mechanical fasteners, thereby eliminating a cost and weight associated with such additional components. The interlocking arrangement 160, 162, 164 may provide improved vibration damping, seal clearance, and minimize leakage without incurring additional cost associated with fabricating and machining mating features.

Figure 8A:
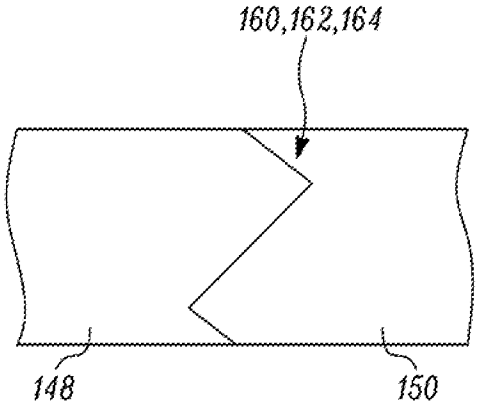
FIGS. 8A, 8B, 8C and 8D are schematic views of alternative interlocking arrangements for coupling of adjacent shroud segments.
Figure 8B:
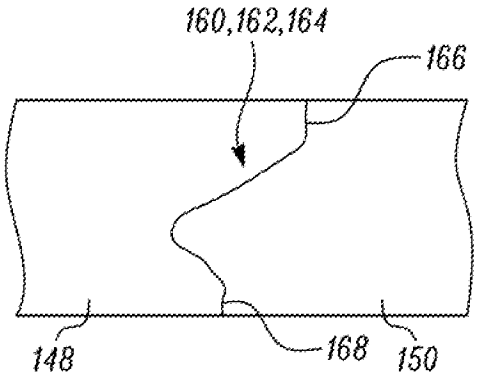
Figure 8C:
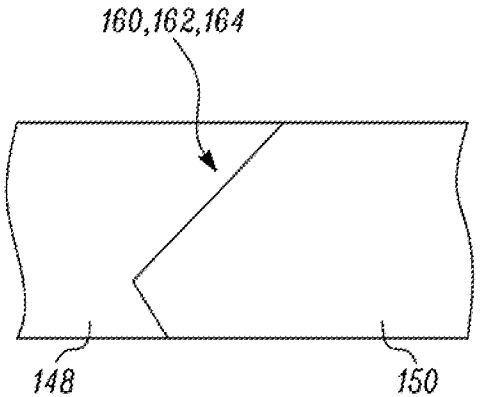
Figure 8D:
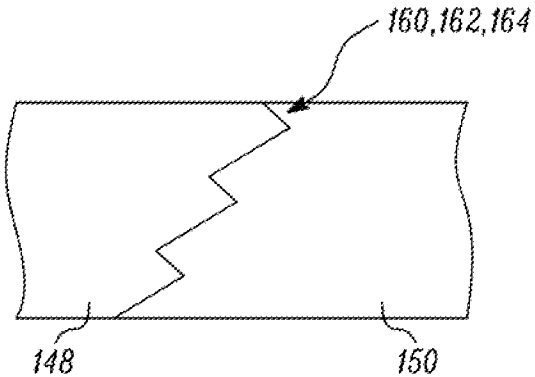

In some embodiments, the interlocking arrangement 160, 162, 164 includes at least one of a Z-shaped arrangement, a V-shaped arrangement with axial end portions 166, 168, a V-shaped arrangement, and a zigzag arrangement (see FIGS. 8A to 8D, respectively). The interlocking arrangement 160, 162, 164 may include a tongue and groove arrangement, a dovetail arrangement, and the like. It should be noted that the interlocking arrangement 160, 162, 164 may include any design that may prevent the axial movement of the shroud segments 148, 150, 152 along the rotational axis 9. As shown in FIG. 8A, the interlocking arrangement 160, 162, 164 connecting the shroud segments 148, 150 includes the Z-shaped arrangement. As shown in FIG. 8B, the interlocking arrangement 160, 162, 164 connecting the shroud segments 148, 150 includes the V-shaped arrangement with the axial end portions 166, 168. As shown in FIG. 8C, the interlocking arrangement 160, 162, 164 connecting the shroud segments 148, 150 includes the V-shaped arrangement. As shown in FIG. 8D, the interlocking arrangement 160, 162, 164 connecting the shroud segments 148, 150 includes the zigzag arrangement.

Figure 9B:
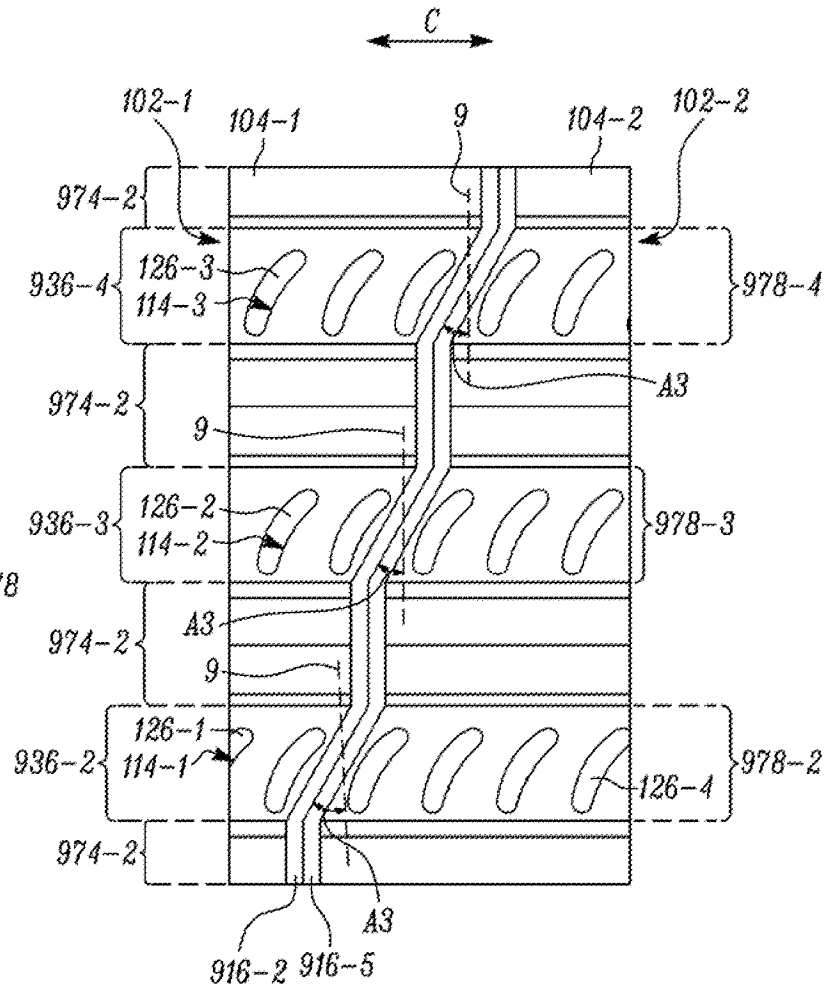
FIG. 9B is a schematic partial plan view illustrating a split-line flange having three circumferentially angled intersecting portions.
Figure 9A:
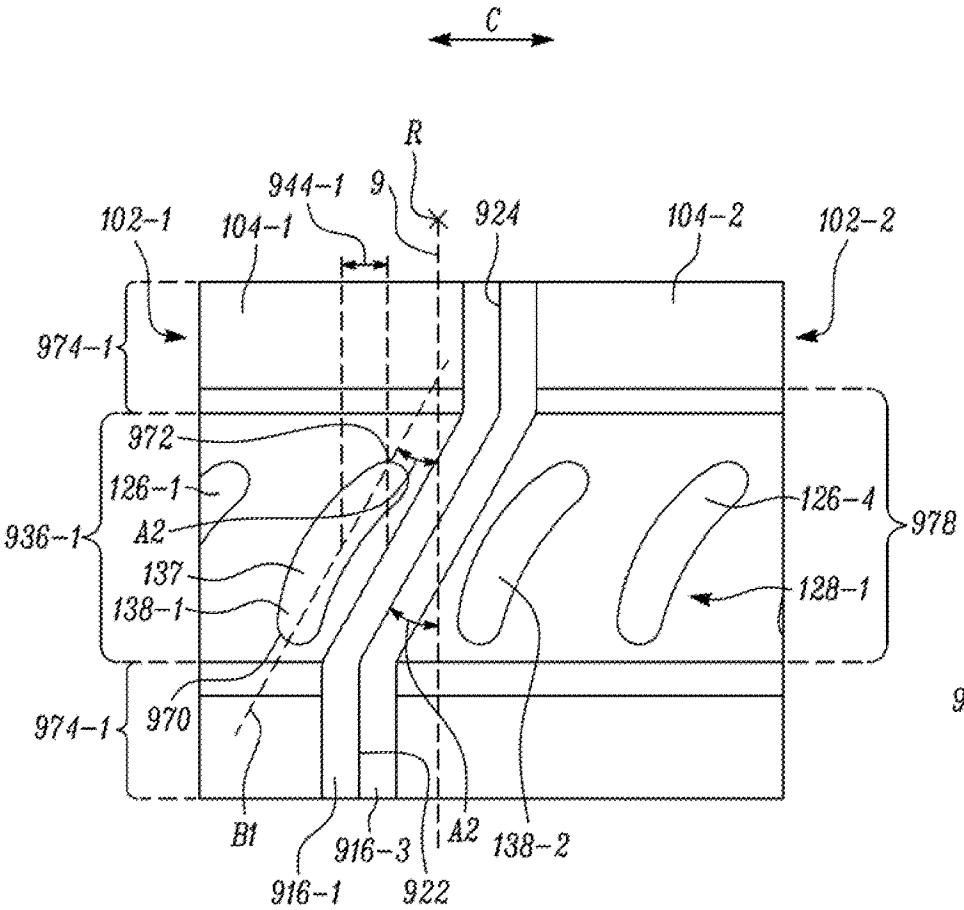
FIG. 9A is a schematic partial plan view illustrating a split-line flange having a circumferentially angled intersecting portion.

FIG. 9A is a schematic view depicting a split-line flange 916-1 associated with the vane casing segment 102 fixedly connected to a split-line flange 916-3 associated with the vane casing segment 102. In the illustrated embodiment of FIG. 9A, the split-line flange 916-1 of the vane casing segment 102-1 is fixedly connected to the split-line flange 916-3 of the vane casing segment 102-2. The split-line flanges 916-1, 916-3 define corresponding mating surfaces 922, 924. Each of the mating surfaces 922, 924 include a planar shape herein. Alternatively, the mating surfaces 922, 924 may include any other shape, such as, a curved or helix shape, without any limitations.

Further, the split-line flange 916-1 includes an intersecting portion 936-1 that may mate with an intersecting portion 978-1 of the adjacent split-line flange 916-3. In some embodiments, at least the intersecting portion 936-1 of the at least one split-line flange 916-1 of each vane casing segment 102 is circumferentially inclined relative to the rotational axis 9 by a circumferential angle A2. Further, the outer platform 137 of the end stator vane 138-1 disposed adjacent to the at least one split-line flange 916-1 defines a chordal axis B1 extending between opposing axial ends 970, 972 of the outer platform 137. The chordal axis B1 is circumferentially inclined relative to the rotational axis 9 by the circumferential angle A2 of the at least one split-line flange 916-1. In some embodiments, the circumferential angle A2 is from about 2 degrees to about 45 degrees. Further, the circumferential angle A2 may be from about 2 degrees to about 10 degrees, without any limitations. Such a range of the circumferential angle A2 may eliminate any interference between the end stator vane 138-1 and the at least one split-line flange 916-1. The circumferentially inclined intersecting portion 936-1 of the split-line flange 916-1 may ensure that the end stator vane 138-1 of the vane casing segment 102 may be disposed at a minimum circumferential clearance 944-1 from the split-line flange 916-1. Further, the circumferentially inclined intersecting portion 936-1 may ensure that the end stator vane 138-1 does not interfere with the split-line flange 916-1. As illustrated herein, the split-line flange 916-1 may also include a pair of axial portions 974-1 that extend parallel to the rotational axis 9. The intersecting portion 936-1 extends between the pair of axial portions 974-1.

Referring to FIG. 9B, in some embodiments, the at least one row of stator vanes 126-1, 126-2, 126-3 further includes the plurality of rows of stator vanes 126-1, 126-2, 126-3 axially spaced apart from each other relative to the rotational axis 9 and fixedly coupled to the arcuate member 104. The at least one row of casing apertures 114-1, 114-2, 114-3 may further include the plurality of rows of casing apertures 114-1, 114-2, 114-3 corresponding to the plurality of rows of stator vanes 126-1, 126-2, 126-3. Further, in some embodiments, each split-line flange 916-2 further includes a plurality of intersecting portions 936-2, 936-3, 936-4 disposed adjacent to the corresponding row of stator vanes 126-1, 126-2, 126-3 from the plurality of rows of stator vanes 126-1, 126-2, 126-3. Further, the intersecting portion 936-2 of the split-line flange 916-2 may mate with an intersecting portion 978-2 of an adjacent split-line flange 916-5. Furthermore, the intersecting portion 936-3 of the split-line flange 916-2 may mate with an intersecting portion 978-3 of the adjacent split-line flange 916-5. Moreover, the intersecting portion 936-4 of the split-line flange 916-2 mates with an intersecting portion 978-4 of the adjacent split-line flange 916-5.

As illustrated in FIG. 9B, at least one intersecting portion 936-2, 936-3, 936-4 from the plurality of intersecting portions 936-2, 936-3, 936-4 may be circumferentially inclined relative to the rotational axis 9. The at least one circumferentially inclined intersecting portion 936-2, 936-3, 936-4 may ensure that the end stator vane 138-1 of the vane casing segment 102 does not interfere with the corresponding split-line flange 916-2. In some embodiments, each intersecting portion 936-2, 936-3, 936-4 from the plurality of intersecting portions 936-2, 936-3, 936-4 is circumferentially inclined relative to the rotational axis 9 by a corresponding circumferential angle A3. Specifically, a value of the circumferential angles A3 of each intersecting portion 936-2, 936-3, 936-4 may be the same. In some embodiments, the circumferential angle A3 is from about 2 degrees to about 45 degrees. Further, the circumferential angle A3 may be from about 2 degrees to about 10 degrees, without any limitations. Such a range of the circumferential angle A3 may eliminate any interference between the end stator vane 138-1 and the corresponding split-line flange 916-2, 916-3, 916-4. Further, the intersecting portions 936-2, 936-3, 936-4 are parallel to each other. As illustrated herein, the split-line flange 916-2 also may also include corresponding axial portions 974-2 that extend parallel to the rotational axis 9. One of the axial portions 974-2 may be axially disposed between the intersecting portions 936-2 and 936-3 relative to the rotational axis 9. Further, one of the axial portions 974-2 may be axially disposed between the intersecting portions 936-3 and 936-4 relative to the rotational axis 9. At least a part of the split-line flange 916-2 may therefore include alternating axially parallel portions and circumferentially inclined portions.

Figure 9D:
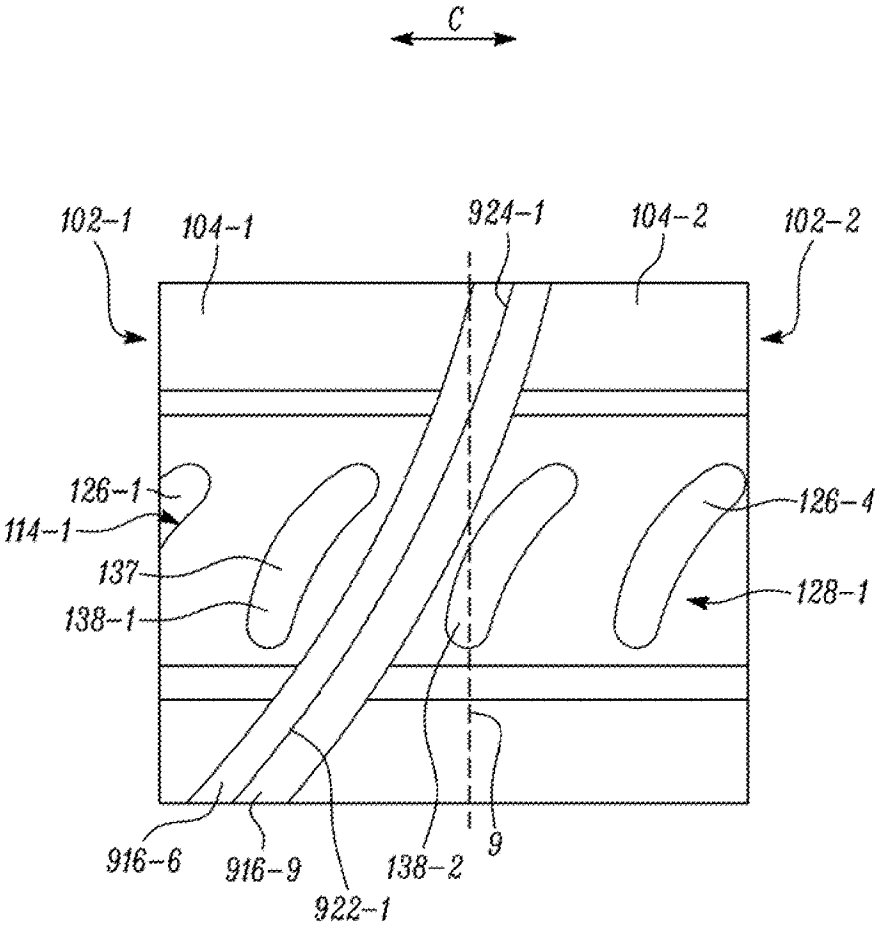
FIG. 9D is a schematic partial plan view illustrating a curved split-line flange.
Figure 9C:
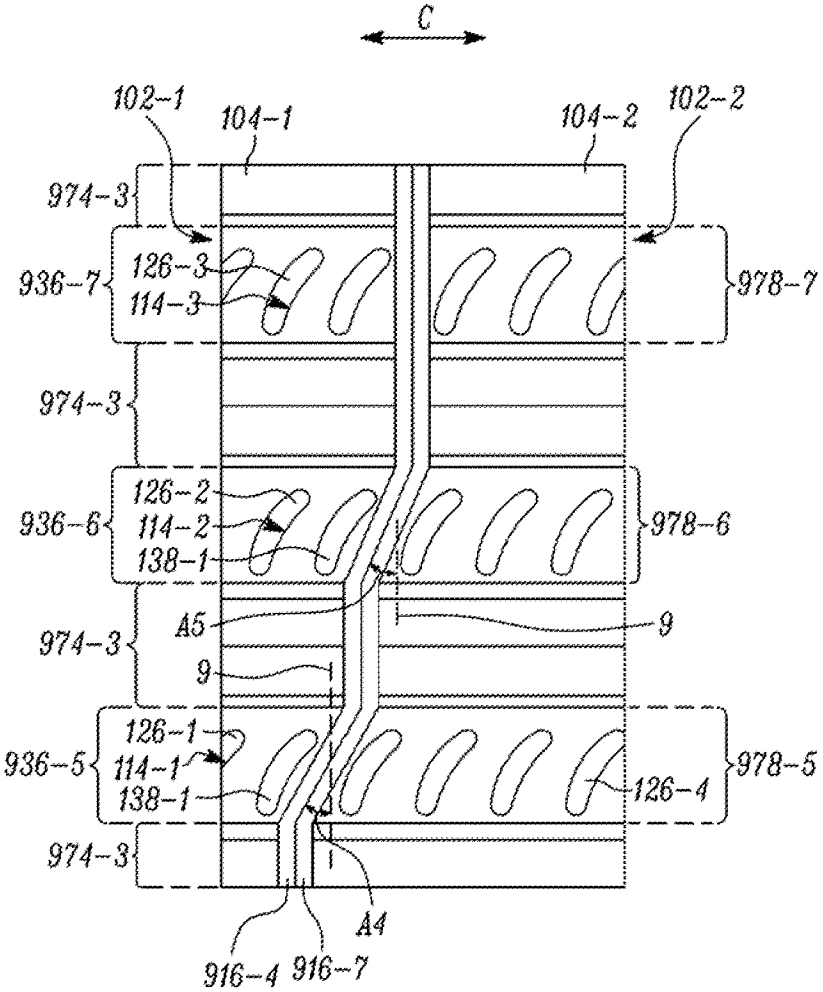
FIG. 9C is a schematic partial plan view illustrating a split-line flange having two circumferentially angled intersecting portions.

FIG. 9C is a schematic view depicting a split-line flange 916-4 associated with the vane casing segment 102 fixedly connected to a split-line flange 916-7 associated with the vane casing segment 102. In the illustrated embodiment of FIG. 9C, the split-line flange 916-4 of the vane casing segment 102-1 is fixedly connected to the split-line flange 916-7 of the vane casing segment 102-2. In some embodiments, the split-line flange 916-4 includes three intersecting portions 936-5, 936-6, 936-7. Further, the intersecting portion 936-5 of the split-line flange 916-4 may mate with a corresponding intersecting portion 978-5 of the split-line flange 916-7. Furthermore, the intersecting portion 936-6 of the split-line flange 916-4 may mate with a corresponding intersecting portion 978-6 of the split-line flange 916-7. Moreover, the intersecting portion 936-7 of the split-line flange 916-4 may mate with a corresponding intersecting portion 978-7 of the split-line flange 916-7.

Each of the three intersecting portions 936-5, 936-6, 936-7 of the split-line flange 916-4 are disposed adjacent to a corresponding row of stator vanes 126-1, 126-2, 126-3. Further, the intersecting portions 936-5, 936-6 may be circumferentially inclined relative to the rotational axis 9 by a corresponding circumferential angle A4, A5. In some embodiments, the corresponding circumferential angles A4, A5 of at least two intersection portions 936-5, 936-6 from the plurality of intersection portions 936-5, 936-6 are different from each other. Specifically, a value of the circumferential angle A4 of the intersecting portion 936-5 may be different from a value of the circumferential angle A5 of the intersecting portion 936-6. The different values of the circumferential angles A4, A5 may be based on different designs of the at least two rows of stator vanes 126-1, 126-2 corresponding to the at least two intersection portions 936-5, 936-6.

In some embodiments, the circumferential angle A4, A5 is from about 2 degrees to about 45 degrees. Further, the circumferential angle A4, A5 may be from about 2 degrees to about 10 degrees, without any limitations. Such a range of the circumferential angle A4, A5 may eliminate any interference between the end stator vane 138-1 and the corresponding split-line flange 916-5, 916-6. Moreover, at least one of the plurality of intersecting portions 936-7 extends parallel to the rotational axis 9. In such an example, a circumferential inclination of the at least one of the plurality of intersecting portions 936-7 may not be required due to a design of the corresponding row of stator vanes 126-3. As illustrated herein, the split-line flange 916-5 may also include corresponding axial portions 974-3 that extend parallel to the rotational axis 9.

FIG. 9D is a schematic view depicting a split-line flange 916-6 associated with the vane casing segment 102 fixedly connected to a split-line flange 916-9 associated with the vane casing segment 102. In the illustrated embodiment of FIG. 9D, the split-line flange 916-6 of the vane casing segment 102-1 is fixedly connected to the split-line flange 916-9 of the vane casing segment 102-2. The split-line flanges 916-6, 916-9 define corresponding mating surfaces 922-1, 924-1. In the illustrated embodiment of FIG. 9D, each of the mating surfaces 922-1, 924-1 include a curved shape. Specifically, the split-line flange 916-6 includes a convex shape and the split-line flange 916-9 includes a concave shape. Alternatively, the mating surfaces 922-1, 924-1 may include any other shape, without any limitations.

Figure 10:
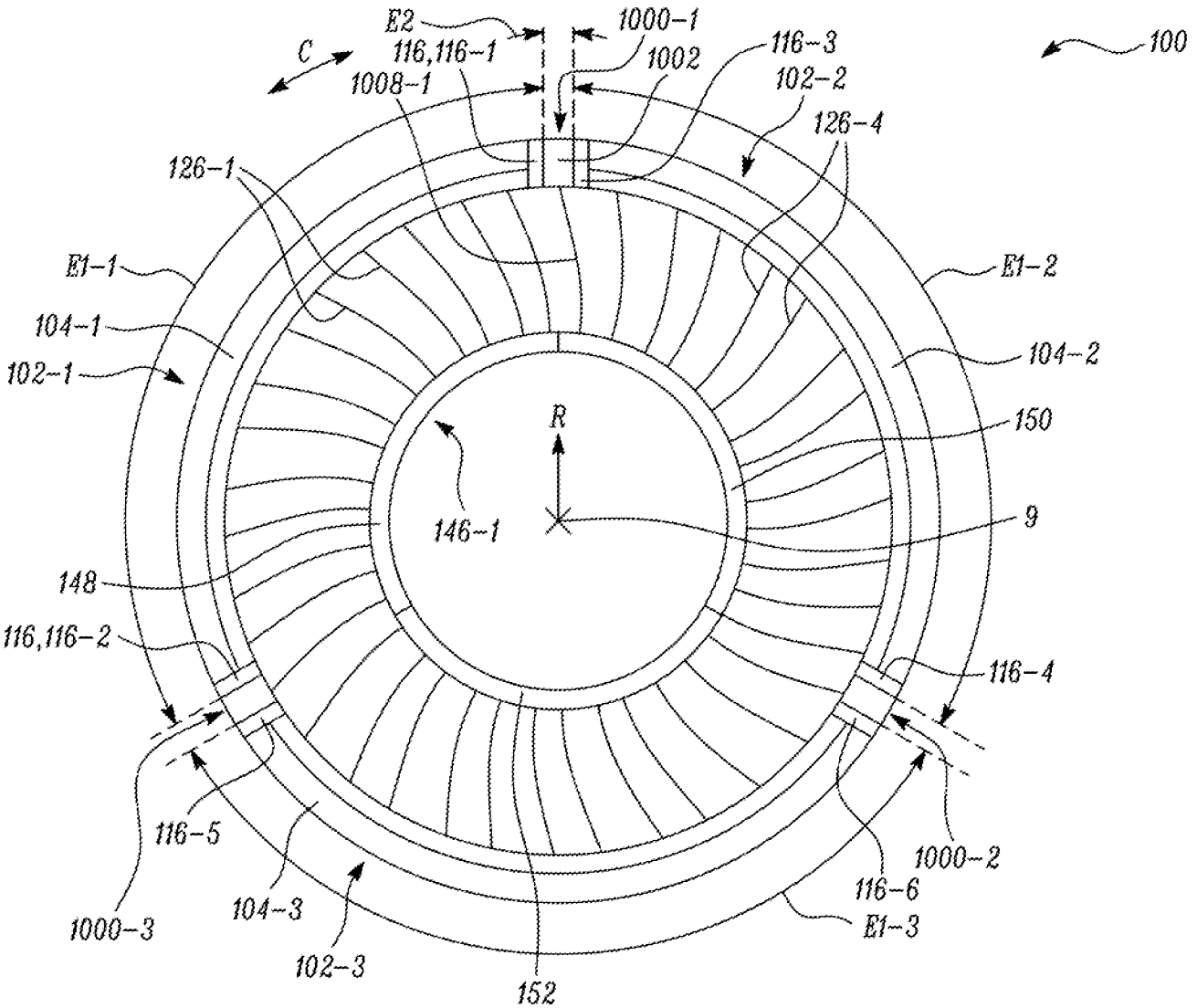
FIG. 10 is a schematic front view of the casing assembly having a number of vane plate units.

Referring now to FIG. 10, the casing assembly 100 may also include a vane plate unit 1000-1, 1000-2, 1000-3. In some embodiments, the plurality of vane casing segments 102-1, 102-2, 102-3 includes at least three vane casing segments 102-1, 102-2, 102-3, such that the angular extent E1-1, E1-2, E1-3 of the arcuate member 104-1, 104-2, 104-3 of each of the at least three vane casing segments 102-1, 102-2, 102-3 is less than 180 degrees about the rotational axis 9. Further, the at least one vane plate unit 1000-1, 1000-2, 1000-3 includes at least three vane plate units 1000-1, 1000-2, 1000-3, such that each of the at least three vane plate units 1000-1, 1000-2, 1000-3 is at least partially and circumferentially disposed between corresponding adjacent vane casing segments 102-1, 102-2, 102-3 of the at least three vane casing segments 102-1, 102-2, 102-3. Specifically, the vane plate unit 1000-1 is circumferentially disposed between the vane casing segments 102-1, 102-2. Further, the vane plate unit 1000-2 is circumferentially disposed between the vane casing segments 102-2, 102-3. Moreover, the vane plate unit 1000-3 is circumferentially disposed between the vane casing segments 102-1, 102-3.

Figure 11:
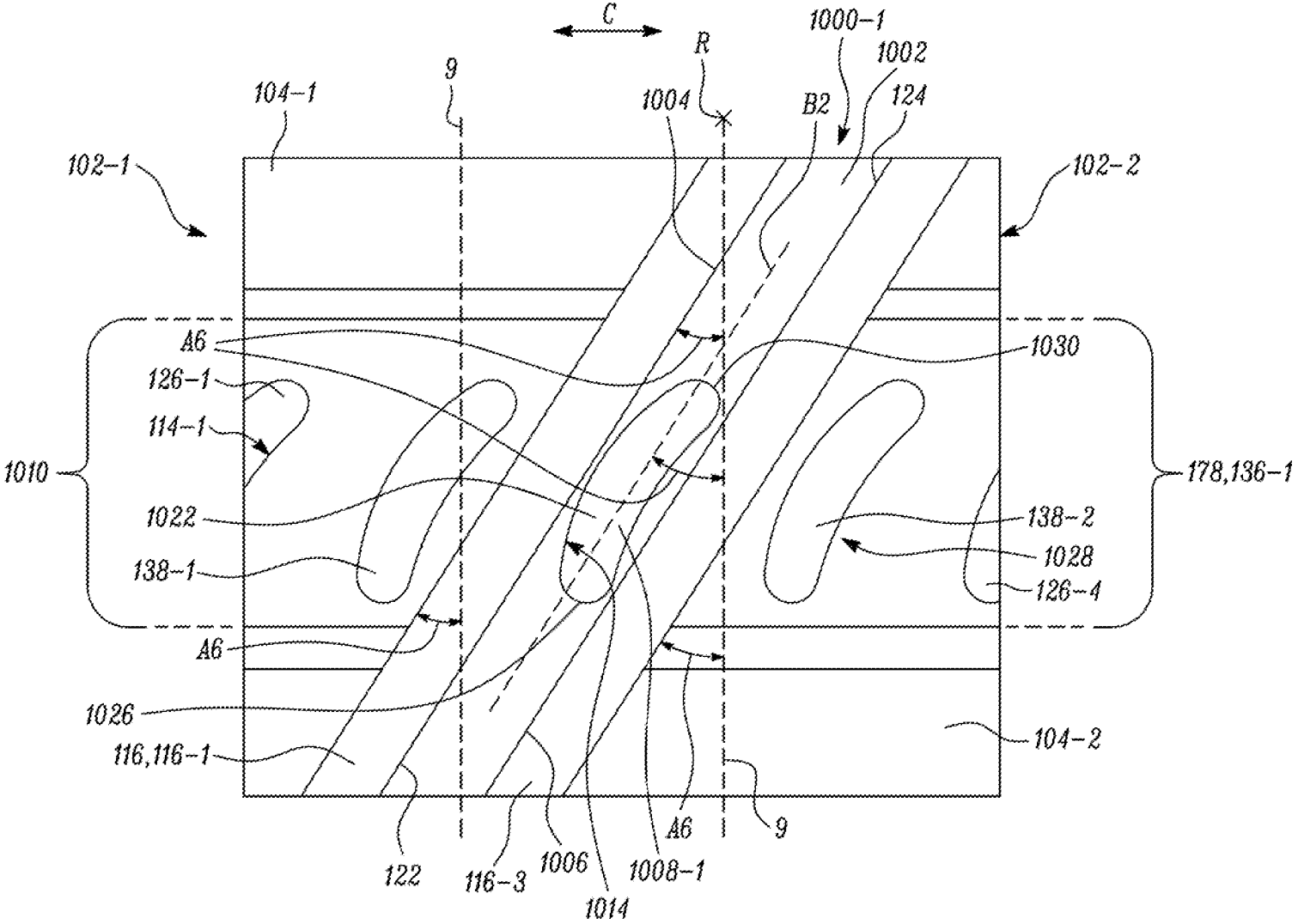
FIG. 11 is a schematic partial plan view illustrating the vane plate unit disposed between two adjacent vane casing segments.

FIG. 11 illustrates the vane plate unit 1000-1 disposed between the vane casing segments 102-1, 102-2. The vane plate unit 1000-1 will now be described in detail. However, details provided below may be equally applicable to the vane plate units 1000-2, 1000-3 shown in FIG. 10, without any limitations. In some embodiments, the casing assembly 100 further includes the at least one vane plate unit 1000-1 at least partially and circumferentially disposed between at least one split-line flange 116 from the pair of split-line flanges 116 of at least one vane casing segment 102-1 from the plurality of vane casing segments 102-1, 102-2, 102-3 (see FIG. 10) and the adjacent split line flange 116-3 of the adjacent vane casing segment 102-2.

The vane plate unit 1000-1 may include a vane plate 1002 including a first mating surface 1004 at least partially engaging with the mating surface 122 of the at least one split-line flange 116 of the at least one vane casing segment 102-1. Further, the split-line flange 116 may be fixedly connected to the vane plate 1002 via mechanical fasteners (not shown), such as, bolts, screws, pins, and the like. Accordingly, the vane plate 1002 may include features, such as, apertures (not shown), to receive the mechanical fasteners. It should be noted that the present disclosure is not limited by a technique of coupling the split-line flange 116 with the vane plate 1002.

The vane plate 1002 may also include an opposing second mating surface 1006 at least partially engaging with the mating surface 124 of the adjacent split line flange 116-3 of the adjacent vane casing segment 102-2. Further, the split-line flange 116-3 may be fixedly connected to the vane plate 1002 via mechanical fasteners, such as, bolts, screws, pins, and the like. It should be noted that the present disclosure is not limited by a technique of coupling the split-line flange 116-3 with the vane plate 1002. The vane plate 1002 described herein may be used when a clearance between the end stator vane 138-1 of the vane casing segment 102-1 and an end stator vane 138-2 of the vane casing segment 102-2 may be such that it may be challenging to accommodate the split-line flange 116 of the vane casing segment 102-1 and the split-line flange 116-3 of the vane casing segment 102-2.

In some embodiments, the vane plate 1002 may be fixedly coupled to each of the at least one split-line flange 116 and the adjacent split-line flange 116-3, such that the at least one split-line flange 116 may be fixedly coupled to the adjacent split-line flange 116-3 via the vane plate 1002. Further, the vane plate 1002 may be at least partially and circumferentially inclined relative to the rotational axis 9. In the illustrated embodiment of FIG. 11, the entire vane plate 1002 is circumferentially inclined relative to the rotational axis 9. Further, the vane plate 1002 may be circumferentially inclined relative to the rotational axis 9 by a circumferential angle A6. The circumferential angle A6 may be from about 2 degrees to about 45 degrees. Further, the circumferential angle A6 may be from about 2 degrees to about 10 degrees, without any limitations.

Referring to FIGS. 10 and 11, In some embodiments, the vane plate 1002 has an angular extent E2 about the rotational axis 9. Further, the arcuate member 104-1, 104-2, 104-3 of each vane casing segment 102-1, 102-2, 102-3 may have the angular extent E1-1, E1-2, E1-3 about the rotational axis 9. Furthermore, the angular extent A2 of each vane casing segment 102-1, 102-2, 102-3 may be greater than the angular extent E2 of the vane plate 1002 by at least a factor of 20. The angular extent E2 of the vane plate 1002 may be governed by a desired clearance between the end stator vanes 138-1, 138-2 of the adjacent vane casing segments 102-1, 102-2.

Figure 12B:
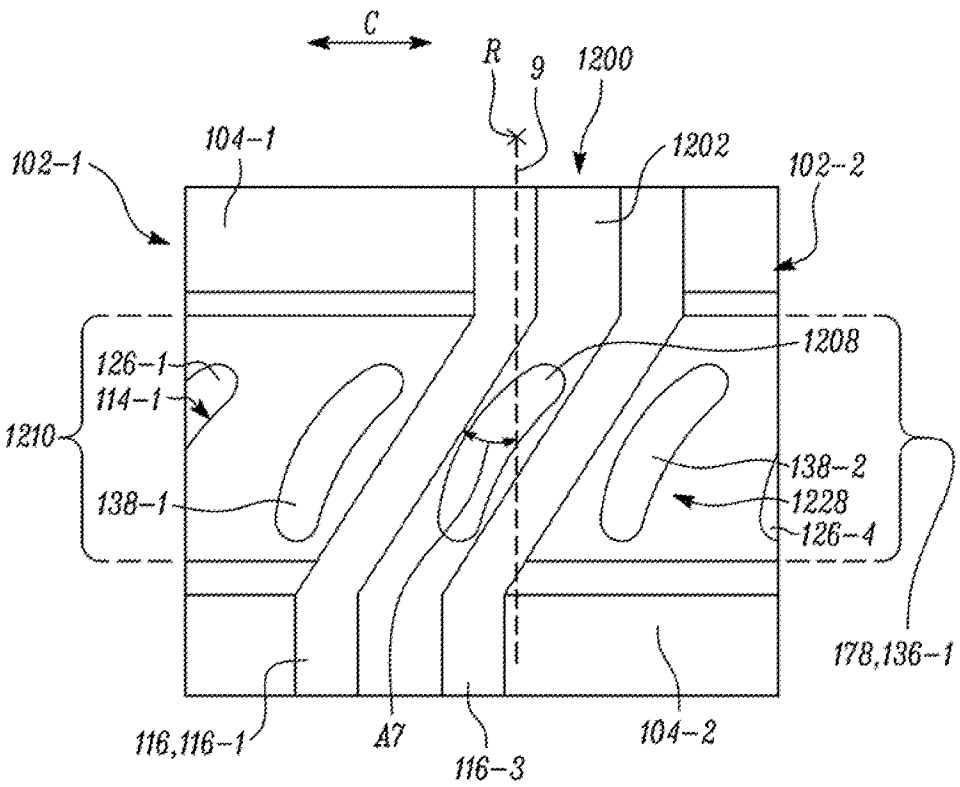
FIG. 12B is a schematic partial plan view illustrating a vane plate unit having a circumferentially angled intersecting portion.
Figure 12A:
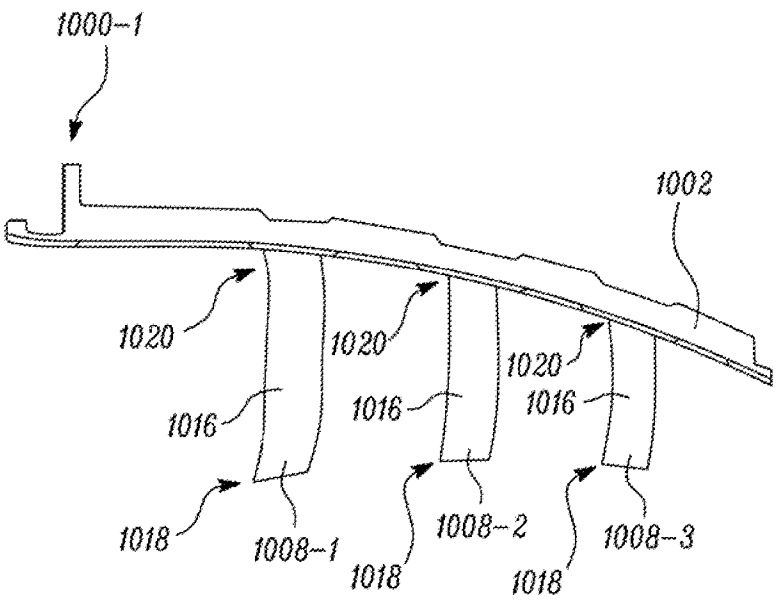
FIG. 12A is a schematic perspective view of the vane plate unit of FIG. 11.

As shown in FIG. 12A, in some embodiments, the vane plate unit 1000-1 includes at least one plate stator vane 1008-1, 1008-2, 1008-3 fixedly coupled to and extending at least radially from the vane plate 1002. In some embodiments, each vane plate unit 1000-1 may include the plurality of plate stator vanes 1008-1, 1008-2, 1008-3. The plate stator vane 1008-1, 1008-2, 1008-3 may be equidistant from each other relative to the rotational axis 9. However, in some other examples, the plate stator vane 1008-1, 1008-2, 1008-3 may be unevenly spaced along the rotational axis 9. In some embodiments, the vane plate 1002 further includes at least one plate aperture 1014 (shown in FIG. 11).

Further, the at least one plate stator vane 1008-1, 1008-2, 1008-3 may include an aerofoil 1016 extending at least radially relative to the rotational axis 9 from a radially inner end 1018 to a radially outer end 1020, and an outer platform 1022 (shown in FIG. 11) disposed at the radially outer end 1020 of the aerofoil 1016. The outer platform 1022 may be at least partially received within the at least one plate aperture 1014 of the vane plate 1002. Further, the plate stator vanes 1008-1, 1008-2, 1008-3 may either be integrally formed with the vane plate 1002 or the plate stator vanes 1008-1, 1008-2, 1008-3 may be coupled to the vane plate 1002 by welding, thereby eliminating usage of additional components, such as, mechanical fasteners. Accordingly, the vane plate 1002 may not increase an overall weight and cost associated with the casing assembly 100.

Referring to FIG. 11, the outer platform 1022 of the at least one plate stator vane 1008-1 may define a chordal axis B2 extending between opposing axial ends 1026, 1030 of the outer platform 1022. The chordal axis B2 may be circumferentially inclined relative to the rotational axis 9 by the same circumferential angle A6. Further, in some embodiments, the at least one plate stator vane 1008-1 is circumferentially disposed between the proximal end stator vane 138-1 of the at least one vane casing segment 102-1 and the proximal end stator vane 138-2 of the adjacent vane casing segment 102-2, such that the at least one row of stator vanes 126-1 of the at least one vane casing segment 102-1, the at least one plate stator vane 1008-1 of the vane plate unit 1000-1, and at least one row of stator vanes 126-4 of the adjacent vane casing segment 102-2 together at least partially form a single circumferential row of stator vanes 1028.

The vane plate 1002 may further include an intersecting portion 1010 axially intersecting the single circumferential row of stator vanes 1028. Further, at least the intersecting portion 1010 of the vane plate 1002, at least the intersecting portion 136-1 of the at least one split-line flange 116 of the at least one vane casing segment 102-1, and at least the intersecting portion 178 of the adjacent split-line flange 116-3 of the adjacent vane casing segment 102-2 may be circumferentially inclined relative to the rotational axis 9 by the same circumferential angle A6. The circumferentially inclined intersecting portion 1010 of the vane plate 1002 may ensure that the plate stator vane 1008-1 is equidistantly disposed between each of the end stator vanes 138-1, 138-2 of the adjacent vane casing segments 102-1, 102-2.

Referring to FIG. 12B, an exemplary vane plate unit 1200 disposed between the vane casing segments 102-1, 102-2 is depicted. The vane plate unit 1200 includes a vane plate 1202 and a plate stator vane 1208. The at least one plate stator vane 1208 may be circumferentially disposed between the proximal end stator vane 138-1 of the at least one vane casing segment 102-1 and the proximal end stator vane 138-2 of the adjacent vane casing segment 102-2, such that the at least one row of stator vanes 126-1 of the at least one vane casing segment 102-1, the at least one plate stator vane 1208 of the vane plate unit 1202, and at least one row of stator vanes 126-4 of the adjacent vane casing segment 102-2 together at least partially form a single circumferential row of stator vanes 1228.

Further, the vane plate 1202 further may include an intersecting portion 1210 axially intersecting the single circumferential row of stator vanes 1228. In the illustrated embodiment of FIG. 12B, only the intersecting portion 1210 of the vane plate 1202 is circumferentially inclined relative to the rotational axis 9 by a circumferential angle A7. Further, at least the intersecting portion 1210 of the vane plate 1202, at least the intersecting portion 136-1 of the at least one split-line flange 116 of the at least one vane casing segment 102-1, and at least the intersecting portion 178 of the adjacent split-line flange 116-3 of the adjacent vane casing segment 102-2 may be circumferentially inclined relative to the rotational axis 9 by the same circumferential angle A7. In some embodiments, the circumferential angle A7 is from about 2 degrees to about 45 degrees. Further, the circumferential angle A7 may be from about 2 degrees to about 10 degrees, without any limitations. The circumferentially inclined intersecting portion 1210 of the vane plate 1202 may ensure that the plate stator vane 1208 is equidistantly disposed between each of the end stator vanes 138-1, 138-2 of the adjacent vane casing segments 102-1, 102-2.

Further, in various embodiments, the vane plate unit 1200 may include multiple intersecting portions (not shown) that may be similar to the intersecting portion 1210. In an example, each of the multiple intersecting portions of the vane plate unit 1200 may be circumferentially inclined relative to the rotational axis 9 by a circumferential angle (not shown). In some examples, the circumferential angles of at least two of the multiple intersecting portions of the vane plate unit 1200 may be different from each other. In other examples, the circumferential angles of at least two of the multiple intersecting portions may be same. Moreover, in some examples, at least one of the multiple intersecting portions of the vane plate unit 1200 may extend parallel to the rotational axis 9.

Referring to FIGS. 1 to 12B, the casing assembly 100 of the present disclosure may be robust in design and may be convenient to assemble around the rotor of the turbine 17, 19 or the compressor 14, 15, without compromising with a design of the rotor. Further, as the rows of stator vanes 126-1, 126-2, 126-3, 126-4, are coupled to the arcuate member 104-1, 104-2 by welding, the casing assembly 100 may have a lower weight as the casing assembly 100 may not require mechanical fasteners, such as, bolts for coupling the rows of stator vanes 126-1, 126-2, 126-3, 126-4 with the arcuate member 104-1, 104-2. Moreover, the casing assembly 100 may be cost effective due to usage of lower volume of materials for manufacturing of the casing assembly 100.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

I claim:

1. A casing assembly for a gas turbine engine having a rotational axis, the casing assembly comprising:

a plurality of vane casing segments circumferentially arranged about the rotational axis and disposed adjacent to each other, each vane casing segment comprising:

an arcuate member extending circumferentially about the rotational axis, the arcuate member comprising a first axial end portion, a second axial end portion axially spaced apart from the first axial end portion relative to the rotational axis, a pair of circumferential ends circumferentially spaced apart from each other relative to the rotational axis and extending between the first axial end portion and the second axial end portion, and at least one row of casing apertures circumferentially spaced apart from each other relative to the rotational axis;

a pair of split-line flanges circumferentially spaced apart from each other relative to the rotational axis, wherein each split-line flange from the pair of split-line flanges is integral with and radially extends from the arcuate member relative to the rotational axis, wherein each split-line flange is disposed at a corresponding circumferential end from the pair of circumferential ends of the arcuate member and extends from the first axial end portion of the arcuate member to the second axial end portion of the arcuate member, wherein each split-line flange comprises a first axial flange end disposed adjacent to the first axial end portion, a second axial flange end disposed adjacent to the second axial end portion, and a mating surface extending between the first axial flange end and the second axial flange end, and wherein each split-line flange is fixedly coupled to an adjacent split-line flange from the pair of split-line flanges of an adjacent vane casing segment from the plurality of vane casing segments; and at least one row of stator vanes circumferentially spaced apart from each other relative to the rotational axis and fixedly coupled to the arcuate member, each stator vane of the at least one row of stator vanes comprising an aerofoil extending at least radially relative to the rotational axis from a radially inner end to a radially outer end and an outer platform disposed at the radially outer end of the aerofoil, wherein the outer platform is at least partially received within a corresponding casing aperture of the at least one row of casing apertures of the arcuate member and welded to the arcuate member, wherein the at least one row of stator vanes is circumferentially disposed between the pair of split-line flanges, the at least one row of stator vanes comprising a pair of end stator vanes disposed at corresponding opposite row ends, such that each end stator vane from the pair of end stator vanes is disposed adjacent to a corresponding split-line flange from the pair of split-line flanges;

wherein each split-line flange is at least partially and circumferentially inclined relative to the rotational axis, such that the first axial flange end is circumferentially offset from the second axial flange end; and each split-line flange comprises an intersecting portion disposed adjacent to the at least one row of stator vanes, and wherein at least the intersecting portion of each split-line flange is circumferentially inclined relative to the rotational axis, such that the outer platform of each end stator vane is at least circumferentially spaced apart from the corresponding split-line flange by a minimum circumferential clearance.

2. The casing assembly of claim 1, further comprising at least one vane plate unit at least partially and circumferentially disposed between at least one split-line flange from the pair of split-line flanges of at least one vane casing segment from the plurality of vane casing segments and the adjacent split-line flange of the adjacent vane casing segment, wherein the vane plate unit comprises:

a vane plate comprising a first mating surface at least partially engaging with the mating surface of the at least one split-line flange of the at least one vane casing segment and an opposing second mating surface at least partially engaging with the mating surface of the adjacent split-line flange of the adjacent vane casing segment, wherein the vane plate is fixedly coupled to each of the at least one split-line flange and the adjacent split-line flange, such that the at least one split-line flange is fixedly coupled to the adjacent split-line flange via the vane plate, and wherein the vane plate is at least partially and circumferentially inclined relative to the rotational axis; and at least one plate stator vane fixedly coupled to and extending at least radially from the vane plate, wherein the at least one plate stator vane is circumferentially disposed between the proximal end stator vane of the at least one vane casing segment and the proximal end stator vane of the adjacent vane casing segment, such that the at least one row of stator vanes of the at least one vane casing segment, the at least one plate stator vane of the vane plate unit, and the at least one row of stator vanes of the adjacent vane casing segment together at least partially form a single circumferential row of stator vanes.

3. The casing assembly of claim 2, wherein the vane plate has an angular extent about the rotational axis, wherein the arcuate member of each vane casing segment has an angular extent about the rotational axis, and wherein the angular extent of each vane casing segment is greater than the angular extent of the vane plate by at least a factor of 20.

4. The casing assembly of claim 2, wherein the vane plate further comprises an intersecting portion axially intersecting the single circumferential row of stator vanes, and wherein at least the intersecting portion of the vane plate, at least the intersecting portion of the at least one split-line flange of the at least one vane casing segment, and at least the intersecting portion of the adjacent split-line flange of the adjacent vane casing segment are circumferentially inclined relative to the rotational axis by a same circumferential angle.

5. The casing assembly of claim 4, wherein the vane plate further comprises at least one plate aperture, wherein the at least one plate stator vane comprises an aerofoil extending at least radially relative to the rotational axis from a radially inner end to a radially outer end and an outer platform disposed at the radially outer end of the aerofoil, wherein the outer platform is at least partially received within the at least one plate aperture of the vane plate, and wherein the outer platform of the at least one plate stator vane defines a chordal axis extending between opposing axial ends of the outer platform, the chordal axis being circumferentially inclined relative to the rotational axis by the same circumferential angle.

6. The casing assembly of claim 2, wherein the plurality of vane casing segments comprises at least three vane casing segments, such that the angular extent of the arcuate member of each of the at least three vane casing segments is less than 180 degrees about the rotational axis, and wherein the at least one vane plate unit comprises at least three vane plate units, such that each of the at least three vane plate units is at least partially and circumferentially disposed between corresponding adjacent vane casing segments of the at least three vane casing segments.

7. The casing assembly of claim 1, wherein the mating surface of at least one split-line flange from the pair of split-line flanges of at least one vane casing segment from the plurality of vane casing segments at least partially engages with the mating surface of the adjacent split-line flange of the adjacent vane casing segment, such that the at least one row of stator vanes of the at least one vane casing segment at least partially forms a single circumferential row of stator vanes, and wherein at least one split-line flange of the at least one vane casing segment is directly and fixedly coupled to the adjacent split-line flange of the adjacent vane casing segment.

8. The casing assembly of claim 7, wherein the arcuate member of the at least one vane casing segment has an angular extent of at most 180 degrees about the rotational axis.

9. The casing assembly of claim 1, wherein the minimum circumferential clearance is from 5 cm to 10 cm.

10. The casing assembly of claim 1, wherein at least the intersecting portion of at least one split-line flange of each vane casing segment is circumferentially inclined relative to the rotational axis by a circumferential angle, and wherein the outer platform of the end stator vane disposed adjacent to the at least one split-line flange defines a chordal axis extending between opposing axial ends of the outer platform, the chordal axis being circumferentially inclined relative to the rotational axis by the circumferential angle of the at least one split-line flange.

11. The casing assembly of claim 10, wherein the circumferential angle is from 2 degrees to 45 degrees.

12. The casing assembly of claim 1, wherein the at least one row of stator vanes further comprises a plurality of rows of stator vanes axially spaced apart from each other relative to the rotational axis and fixedly coupled to the arcuate member, wherein the at least one row of casing apertures further comprises a plurality of rows of casing apertures corresponding to the plurality of rows of stator vanes, wherein each split-line flange further comprises a plurality of intersecting portions disposed adjacent to a corresponding row of stator vanes from the plurality of rows of stator vanes, and wherein at least one intersecting portion from the plurality of intersecting portions is circumferentially inclined relative to the rotational axis.

13. The casing assembly of claim 12, wherein each intersecting portion from the plurality of intersecting portions is circumferentially inclined relative to the rotational axis by a corresponding circumferential angle.

14. The casing assembly of claim 13, wherein the corresponding circumferential angles of at least two intersection portions from the plurality of intersection portions are different from each other.

15. The casing assembly of claim 13, wherein at least one of the plurality of intersecting portions extends parallel to the rotational axis.

16. The casing assembly of claim 1, further comprising a shroud radially spaced apart from the plurality of vane casing segments relative to the rotational axis, wherein the shroud comprises a plurality of shroud segments circumferentially arranged about the rotational axis and disposed adjacent to each other, wherein each shroud segment comprises at least one row of shroud apertures circumferentially spaced apart from each other relative to the rotational axis, and wherein the radially inner end of the aerofoil of each stator vane of the at least one row of stator vanes is at least partially received within a corresponding shroud aperture of the at least one row of shroud apertures of a corresponding shroud segment from the plurality of shroud segments.

17. The casing assembly of claim 16, wherein each shroud segment and an adjacent shroud segment together form an interlocking arrangement that connects each shroud segment to the adjacent shroud segment.

18. The casing assembly of claim 16, further comprising a potting material disposed in each shroud aperture of the at least one row of shroud apertures, such that the potting material surrounds the radially inner end of the aerofoil received within the corresponding shroud aperture and fixedly couples the radially inner end to the corresponding shroud segment.

19. One of a turbine and a compressor for a gas turbine engine, the one of the turbine and the compressor includes the casing assembly of claim 1.

20. A gas turbine engine that includes the casing assembly of claim 1.

* * * * *